US008422723B2

(12) United States Patent
Takewa et al.

(10) Patent No.: US 8,422,723 B2
(45) Date of Patent: Apr. 16, 2013

(54) LOUDSPEAKER AND ELECTRONIC DEVICE INCLUDING LOUDSPEAKER

(75) Inventors: Hiroyuki Takewa, Osaka (JP); Atsushi Inaba, Mie (JP)

(73) Assignee: Panasonic Corporation, Osaka (JP)

( * ) Notice: Subject to any disclaimer, the term of this patent is extended or adjusted under 35 U.S.C. 154(b) by 69 days.

(21) Appl. No.: 12/812,824

(22) PCT Filed: Nov. 17, 2009

(86) PCT No.: PCT/JP2009/006162

§ 371 (c)(1),
(2), (4) Date: Jul. 14, 2010

(87) PCT Pub. No.: WO2010/058556

PCT Pub. Date: May 27, 2010

(65) Prior Publication Data

US 2011/0211725 A1 Sep. 1, 2011

(30) Foreign Application Priority Data

Nov. 19, 2008 (JP) ..... 2008-295207

(51) Int. Cl.

| | |
|---|---|
| ***H04R 1/22*** | (2006.01) |
| ***H04R 1/28*** | (2006.01) |
| ***H04R 9/04*** | (2006.01) |
| *H04R 1/20* | (2006.01) |
| *H04R 9/02* | (2006.01) |

(52) U.S. Cl.
USPC ..... 381/396; 381/407

(58) Field of Classification Search ..... 381/396, 381/400, 403, 405, 407, 433, 431
See application file for complete search history.

(56) References Cited

U.S. PATENT DOCUMENTS 4,322,584 A 3/1982 Shimada et al.
4,517,416 A * 5/1985 Goossens ..... 381/431

(Continued)

FOREIGN PATENT DOCUMENTS

EP 1 750 477 A1 2/2007
JP 55018156 A * 2/1980

(Continued)

OTHER PUBLICATIONS

International Search Report issued Mar. 2, 2010 in corresponding International Application No. PCT/JP2009/006162.

*Primary Examiner* — Edgardo San Martin
(74) *Attorney, Agent, or Firm* — Wenderoth, Lind & Ponack, L.L.P.

(57) ABSTRACT

An elongated loudspeaker having high sound quality includes an elongated flat-plate-shaped diaphragm, a frame having an opening portion larger than the diaphragm, an edge placed between an inner periphery of the frame around the opening portion and an outer periphery of the diaphragm allowing the diaphragm to vibrate, a coupling cone extending from a rear surface of the diaphragm and including two elongated portions arranged parallel to a longitudinal direction of the diaphragm, a voice coil wound around at least the two elongated portions, and a magnetic circuit that imparts, to the voice coil, a driving force for generating sound. A distance between the two elongated portions of the coupling cone is smaller at end positions than at root positions. The elongated portions are shaped/sized such that the entire two elongated portions are included within magnetic gaps of the magnetic circuit when the coupling cone vibrates along with the diaphragm.

20 Claims, 21 Drawing Sheets

U.S. PATENT DOCUMENTS

| | | | | | |
|---|---|---|---|---|---|
| 4,567,327 | A | * | 1/1986 | Goossens et al. | 381/185 |
| 4,635,750 | A | * | 1/1987 | Suzuki | 381/407 |
| 4,699,242 | A | * | 10/1987 | Ono | 181/170 |
| 5,073,946 | A | * | 12/1991 | Satoh et al. | 381/349 |
| 5,323,469 | A | * | 6/1994 | Scholz | 381/403 |
| 5,862,242 | A | * | 1/1999 | Takewa et al. | 381/398 |
| 6,341,167 | B1 | * | 1/2002 | Okuyama et al. | 381/407 |
| 6,343,136 | B2 | * | 1/2002 | Tokusho et al. | 381/398 |
| 6,594,372 | B2 | * | 7/2003 | Nakaso | 381/396 |
| 6,654,475 | B2 | * | 11/2003 | Nakaso | 381/396 |
| 6,672,423 | B2 | * | 1/2004 | Kato | 181/161 |
| 6,920,957 | B2 | * | 7/2005 | Usuki et al. | 181/173 |
| 7,333,620 | B2 | | 2/2008 | Nguyen et al. | |
| 7,848,536 | B2 | * | 12/2010 | Sadaie et al. | 381/401 |
| 8,031,902 | B2 | * | 10/2011 | Takewa | 381/431 |
| 8,170,267 | B2 | * | 5/2012 | Kim et al. | 381/396 |
| 2007/0160257 | A1 | * | 7/2007 | Stiles | 381/421 |
| 2008/0230304 | A1 | | 9/2008 | Windischberger et al. | |
| 2010/0322458 | A1 | * | 12/2010 | Takewa | 381/398 |

FOREIGN PATENT DOCUMENTS

| | | | | |
|---|---|---|---|---|
| JP | 56-8393 | | | 1/1981 |
| JP | 56140797 | A | * | 11/1981 |
| JP | 56-169696 | | | 12/1981 |
| JP | 57-136895 | | | 8/1982 |
| JP | 58222700 | A | * | 12/1983 |
| JP | 59032292 | A | * | 2/1984 |
| JP | 59171399 | A | * | 9/1984 |
| JP | 60128799 | A | * | 7/1985 |
| JP | 60167596 | A | * | 8/1985 |
| JP | 60219896 | A | * | 11/1985 |
| JP | 60219899 | A | * | 11/1985 |
| JP | 61-121695 | | | 6/1986 |
| JP | 63042299 | A | * | 2/1988 |
| JP | 63246100 | A | * | 10/1988 |
| JP | 01027399 | A | * | 1/1989 |
| JP | 6-41298 | | | 5/1994 |
| JP | 7-298389 | | | 11/1995 |
| JP | 11-187484 | | | 7/1999 |
| JP | 2001-211497 | | | 8/2001 |
| JP | 2003-32786 | | | 1/2003 |
| JP | 2003-244790 | | | 8/2003 |
| JP | 2003-274486 | | | 9/2003 |
| JP | 2005-12694 | | | 1/2005 |
| JP | 2006-5574 | | | 1/2006 |
| WO | 2005/117489 | | | 12/2005 |

* cited by examiner (a)

(b)

(c)

(b)

(a)

(b)

(a)

(b)

(a)

(b)

(a)

(b)

(c)

LOUDSPEAKER AND ELECTRONIC DEVICE INCLUDING LOUDSPEAKER

TECHNICAL FIELD

The present invention relates to a loudspeaker, and in particular, relates to a technique of reducing a loudspeaker in width and thickness.

BACKGROUND ART

In recent years, thin televisions such as a liquid crystal television and a plasma television are widely used. Further, the start of digital broadcasting has been increasing demand for large televisions. Among such large televisions, there is a high demand for high-definition televisions and full high-definition televisions, and so-called wide-screen televisions having an aspect ratio of 16:9 dominate a majority.

On the other hand, in view of the housing conditions in Japan, an entire television set is desired to be narrow and thin.

A television loudspeaker unit is usually attached to both sides of an image display device so as to output stereo sound with improved effect, which contributes to the increase in width of the entire television set.

Thus, conventionally, loudspeakers commonly included in a television loudspeaker unit are of elongated shapes (hereinafter referred to as a "narrow loudspeaker") such as rectangular or elliptical. Further, demand is strong for even narrower loudspeakers because of the increase in width of image display devices, while demand is also strong for narrow loudspeakers, having high sound quality that are capable of reproducing dynamic sound commensurate with the dynamism of the large screens. Furthermore, image display devices have also been being reduced in thickness, and therefore there is also a demand for the reduction in thickness of narrow loudspeakers.

Here, the following is a description of a conventional typical narrow loudspeaker. FIG. 26(*a*) through (*c*) is a diagram showing the structure of a conventional narrow loudspeaker. FIG. 26(*a*) is a plan view; FIG. 26(*b*) is a cross-sectional view taken in the longitudinal direction (c-c'); and FIG. 26(*c*) is a cross-sectional view taken in the transverse direction (o-o'). A narrow loudspeaker 100 shown in FIG. 26(*a*) through (*c*) includes a magnet 101, a plate 102, a center pole 103, a frame 104, a voice coil bobbin 105, a voice coil 106, a damper 107, a diaphragm 109, a dust cap 110, and an edge 111. Further, magnetic gaps 108 are formed with the magnet 101, the plate 102, and the center pole 103.

The voice coil 106 is a winding formed of a conductor such as copper or aluminum, and is fixed to the cylindrical voice coil bobbin 105. The voice coil bobbin 105 supports the voice coil 106 so as to suspend the voice coil 106 within the magnetic gaps 108. The voice coil bobbin 105 is connected to the frame 104 through the damper 107. The voice coil bobbin 105 is adhered to the diaphragm 109 on the opposite side of the voice coil bobbin 105 to that on which the voice coil 106 is fixed to the voice coil bobbin 105, the diaphragm 109 being of an elliptical or generally elliptical shape. The dust cap 110 is fixed to the central portion of the diaphragm 109, and has a cross section of a generally semicircular shape. The edge 111 is of a loop shape and has a cross section of a semicircular shape, and the inner peripheral portion of the edge 111 is fixed to the outer peripheral portion of the diaphragm 109. The outer peripheral portion of the edge 111 is fixed to the frame 104.

In order to drive the narrow loudspeaker 100, alternating current is applied to the voice coil 106. Then the voice coil bobbin 105 makes piston movements based on the alternating current flowing through the voice coil 106 and the magnetic field produced around the voice coil 106, and thereby the diaphragm 109 vibrates in the direction of the piston movements. Consequently, sound waves are emitted from the diaphragm 109.

Patent Literature 1 discloses a loudspeaker having a similar structure to that of the narrow loudspeaker 100. FIG. 27 is a diagram showing the frequency characteristics of the reproduction sound pressure level of the conventional narrow loudspeaker disclosed in Patent Literature 1. The vertical axis represents the reproduction sound pressure level obtained at the point 1 m away from the loudspeaker on an axis extending forward therefrom when 1 W is input thereto, and the horizontal axis represents the driving frequency.

Citation List

[Patent Literature]

[PTL 1] Japanese Laid-Open Patent Publication No. 7-298389

SUMMARY OF INVENTION

Technical Problem

The conventional narrow loudspeaker as described above has the following problems.

The narrow loudspeaker 100 shown in FIG. 26 employs a method of driving the central portion of the elongated diaphragm 109, and therefore is likely to cause break-up resonances in the longitudinal direction. Thus the frequency characteristics of the reproduction sound pressure level have peaks and dips in the mid-range and high range, which causes the deterioration of sound quality. For example, in the frequency characteristics shown in FIG. 27, noticeable dips are observed at around 2 kHz, 3 kHz, and 5 kHz. Further, the diaphragm 109 of the narrow loudspeaker 100 is of a deep shape, so as to improve rigidity because of resonances likely to occur in the longitudinal direction. Additionally, the damper 107 is fixed to the middle of the voice coil bobbin 105, and space is provided between the voice coil bobbin 105 and a magnetic circuit, as a buffer for vibration-range-related collision. Specifically, the diaphragm 109, the upper portion of the voice coil bobbin 105, the damper 107, the lower portion of the voice coil bobbin 105, and the magnetic circuit are placed in this order in series in the vibration direction, and therefore the depth of the loudspeaker is the total thickness of the components placed in series. This makes it difficult to reduce the entire thickness of the loudspeaker.

Thus it is an object of the present invention to provide an elongated loudspeaker having high sound quality that is unlikely to cause break-up resonances and is capable of obtaining flat frequency characteristics.

Solution to Problem

The present invention is directed to a loudspeaker. To solve the above problems, the loudspeaker according to the present invention is a loudspeaker, elongated as viewed from a direction in which sound waves are emitted therefrom, the loudspeaker including: an elongated flat-plate-shaped diaphragm; a frame having an opening portion larger than the diaphragm; an edge placed between an inner periphery of the frame around the opening portion and an outer periphery of the diaphragm and supporting and allowing the diaphragm to easily vibrate in the emission direction of sound waves, with the diaphragm orthogonal to the emission direction; a coupling cone extending from a rear surface of the diaphragm, as viewed from the emission direction of sound waves, and including two elongated portions arranged parallel to a longitudinal direction of the diaphragm, the coupling cone vibrating in conjunction with the diaphragm; a voice coil wound around at least the two elongated portions of the coupling cone; and a magnetic circuit that imparts, to the voice coil, driving force for generating sound waves, and a distance between the two elongated portions of the coupling cone is smaller at end positions than at root positions, the end positions being furthest from the rear surface of the diaphragm and the root positions being closest to the rear surface; and the two elongated portions of the coupling cone are of such shapes and sizes that the entire two elongated portions are included within respective magnetic gaps of the magnetic circuit when the coupling cone vibrates in conjunction with the diaphragm, the entire two elongated portions extending from the root positions to the end positions, respectively.

The coupling cone preferably has an air-permeable structure.

A longitudinal length of the coupling cone is preferably 60% or more of a longitudinal length of the diaphragm.

The root positions of the two elongated portions of the coupling cone are preferably substantially the same as positions of respective nodes of a first resonant mode in a transverse direction of the diaphragm.

The coupling cone preferably has reinforcing ribs in the two elongated portions, the reinforcing ribs forming projections and depressions parallel to the longitudinal direction of the diaphragm.

The diaphragm preferably has reinforcing ribs between the two elongated portions of the coupling cone extending from the rear surface of the diaphragm, the reinforcing ribs forming projections and depressions parallel to the longitudinal direction of the diaphragm.

The magnetic circuit preferably comprises a plurality of magnetic circuits arranged in the longitudinal direction of the diaphragm, and the loudspeaker preferably further includes a damper between each adjacent pair of the magnetic circuits, the damper being connected to part of the end positions of the two elongated portions of the coupling cone and supporting and allowing the coupling cone to easily vibrate in the emission direction of sound waves.

The damper preferably has rolls extending parallel to the longitudinal direction of the diaphragm.

The loudspeaker preferably further includes dampers on far end sides of the magnetic circuits arranged at both ends.

In the damper, the part connected to the coupling cone is preferably of a truncated pyramidal shape.

The connecting part between the damper and the coupling cone preferably forms a prismatic structure based on a combination of the damper and the coupling cone.

In the coupling cone, the part connected to the damper is preferably integrally molded with part of a reinforcing member to form the prismatic structure when connected.

The present invention is directed to an electronic device, such as a television or an automobile, having incorporated therein the loudspeaker. To solve the above problems, the electronic device according to the present invention is an electronic device having mounted therein a loudspeaker elongated as viewed from a direction in which sound waves are emitted therefrom, and the electronic device has mounted therein the loudspeaker.

Advantageous Effects of Invention

As described above, in the present invention, even when the central portion of a diaphragm of a narrow loudspeaker is not shaped into a dome, it is possible to suppress the occurrence of break-up resonances in the diaphragm, realize high sound quality by extending the limiting high frequency of the loudspeaker, and reduce the loudspeaker in width and thickness. Specifically, based on the present invention, with the provision of two elongated portions arranged in the longitudinal direction in a coupling cone, it is possible to suppress resonances in the longitudinal direction of the diaphragm. Further, based on the contact positions, in the transverse direction, between the coupling cone and the diaphragm, it is also possible to suppress first resonances in the transverse direction of the diaphragm.

In addition, since the two elongated portions of the coupling cone, around which a voice coil is wound, are inclined and are of such shapes and sizes that the two elongated portions are included within respective magnetic gaps, it is possible to improve the strength and allow the coupling cone to vibrate greatly without contacting the magnetic gaps. Thus the loudspeaker according to the present invention is capable of vibrating greatly for its size and thickness, and excels in bass reproduction.

In addition, with the use of an air-permeable mesh structure as the coupling cone, it is possible to realize a loudspeaker that suppresses the generation of sound from the coupling cone itself and reproduces sound with reduced distortion.

Further, with the provision of reinforcing ribs in the two elongated portions of the coupling cone, it is possible to realize a loudspeaker that has high rigidity, excels in transmitting driving force, and reproduces sound with further reduced distortion.

Still further, with the provision of reinforcing ribs in the diaphragm at the portion between the two elongated portions, it is possible to realize a loudspeaker that has high rigidity, excels in transmitting driving force, and reproduces sound with further reduced distortion.

Furthermore, with the provision of a damper at the lower ends of the coupling cone, it is possible to realize a steady supporting structure that is thin yet allows great vibrations.

Moreover, an electronic device, such as a television, a mobile phone, or an automobile, that has mounted therein the loudspeaker as described above is capable of reproducing high-quality sound without significantly increasing the width and thickness thereof.

BRIEF DESCRIPTION OF DRAWINGS

FIG. 1(*b*) is a cross-sectional view (a cross section A-A') taken in the longitudinal direction, and at an approximate center, of the loudspeaker. FIG. 1(*c*) is a cross-sectional view (a cross section B-B') taken in the transverse direction, and at an approximate center, of the loudspeaker.

FIG. 5(*b*) is a cross-sectional view (a cross section B-B') taken in the transverse direction of the diaphragm 30 and the edge 12.

FIG. 6(*b*) is a diagram showing the diaphragm 40 and the edge 12, as viewed from the front direction (as viewed from above, in FIG. 6(*a*)) in which sound waves are mainly emitted. FIG. 6(*c*) is a cross-sectional view (a cross section A-A') taken in the longitudinal direction of the diaphragm 40 and the edge 12.

FIG. 7(*b*) is a diagram showing the coupling cone 51, as viewed from the front direction (as viewed from above, in FIG. 7(*a*)) in which sound waves are mainly emitted. FIG. 7(*c*) is a side view of the coupling cone 51.

FIG. 10(*b*) is a cross-sectional view (a cross section A-A') taken in the longitudinal direction, and at an approximate center, of the loudspeaker.

FIG. 11(*b*) is a cross-sectional view (a cross section C-C') taken in the transverse direction, and at an approximate center, of the loudspeaker.

FIG. 16(*b*) is a cross-sectional view (a cross section A-A') taken in the longitudinal direction, and at an approximate center, of the loudspeaker.

FIG. 17(*b*) is a cross-sectional view (a cross section C-C' and a cross section E-E') taken in the transverse direction, and at around the midpoints between the longitudinal ends and center, of the loudspeaker. FIG. 17(*c*) is a cross-sectional view (a cross section D-D') taken in the transverse direction, and at an approximate center, of the loudspeaker.

DESCRIPTION OF EMBODIMENTS

[First Embodiment]

<Structure>

Figure 1:
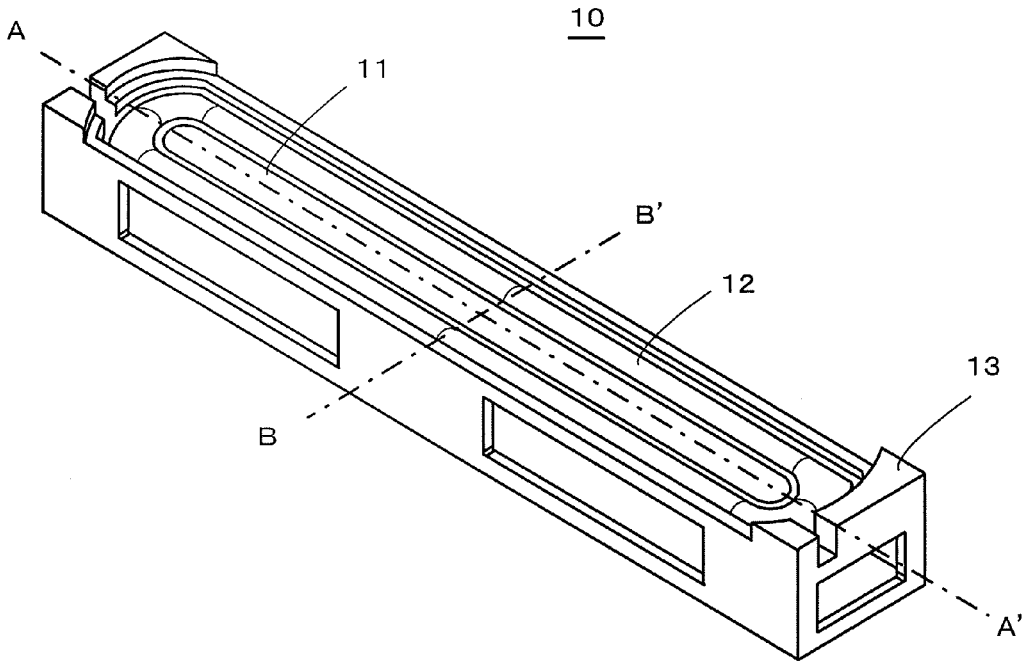
FIG. 1(*a*) is a perspective view of the appearance of a loudspeaker 10 according to a first embodiment.
Figure 1:
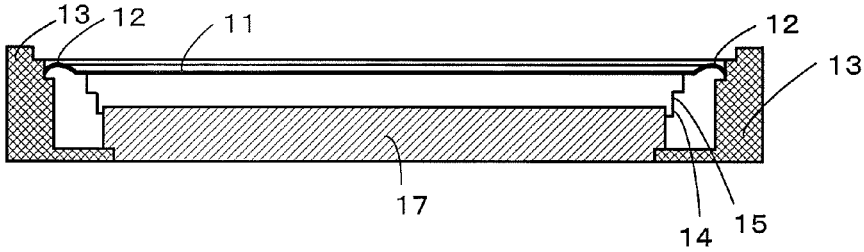
Figure 1:
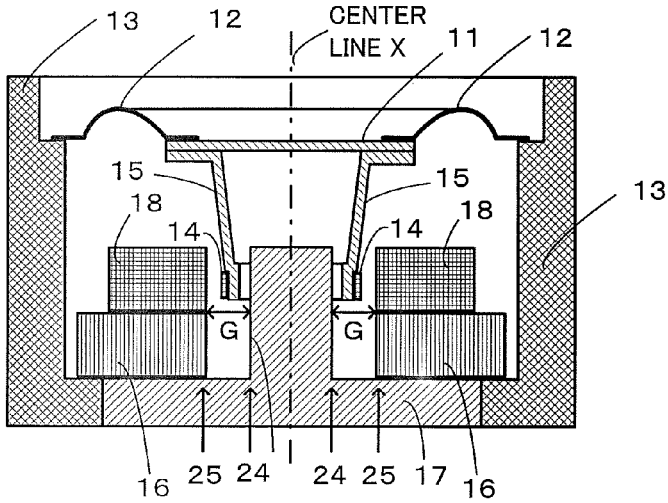

FIG. 1(*a*) is a perspective view of the appearance of a loudspeaker 10 according to a first embodiment. FIG. 1(*b*) is a cross-sectional view (a cross section A-A') taken in the longitudinal direction, and at an approximate center, of the loudspeaker. FIG. 1(*c*) is a cross-sectional view (a cross section B-B') taken in the transverse direction, and at an approximate center, of the loudspeaker.

The loudspeaker 10 shown in FIG. 1(*a*) through (*c*) is a narrow loudspeaker of an elongated shape, whose longitudinal and transverse lengths differ from each other when viewed from the front direction (as viewed from above, in FIG. 1(*b*) and (*c*)) in which sound waves are mainly emitted. The loudspeaker 10 includes a diaphragm 11, an edge 12, a frame 13, a voice coil 14, a coupling cone 15, magnets 16, a center pole 17, and top plates 18.

As shown in FIG. 1(*a*) through (*c*), the diaphragm 11 is of a generally flat shape, and of a race-track-like elongated shape whose outlines on the long sides are straight lines and whose outlines on the short sides are arcs. Further, the edge 12 surrounds the outer periphery of the diaphragm 11 in a loop manner, and has a cross section of a generally semicircular shape (see FIG. 1(*c*)). The frame 13 is of a loop shape having a large opening portion particularly on the front face thereof. Here, the outer periphery of the diaphragm 11 is fixed to the inner periphery of the edge 12. The outer periphery of the edge 12 is fixed to the frame 13 around the opening portion of the frame 13.

Note that the diaphragm 11 only needs to be of an elongated shape, and does not necessarily need to be of a race-track-like elliptical shape. Thus the outlines on the short sides of the diaphragm 11 may not be arcs and may be other curves. Further, the outlines on the short sides of the diaphragm 11 do not necessarily need to be curves. Thus the diaphragm 11 may be, for example, of an elongated rectangular shape. Furthermore, the following are suitable for the materials of the diaphragm 11 and the edge 12: paper; lightweight, high rigidity metal foil formed of, for example, aluminum or titanium; polymer film formed of, for example, polyimide; or the like. Note that the diaphragm 11 and the edge 12 may be formed of different materials, or may be formed of the same material. Alternatively, the diaphragm 11 and the edge 12 may be integrally molded of the same material.

The two magnets 16, the center pole 17, and the two top plates 18 form an open-type magnetic circuit and are fixed to the frame 13, so as to generate magnetic flux in magnetic gaps ("G" in FIG. 1(*c*)) and provide the voice coil 14, placed within the magnetic gaps, with driving force for generating sound waves. Similarly to the diaphragm 11, the magnets 16, the center pole 17, and the top plates 18 are of elongated shapes when viewed from the front direction. The magnets 16, the center pole 17, and the top plates 18 are placed such that the longitudinal direction of each coincides with the longitudinal direction of the diaphragm 11. Transverse cross sections of the magnets 16 are of rectangular shapes when viewed along the longitudinal direction, and the magnets 16 are fixed to the two bottom surfaces, respectively, that are formed by the frame 13 and the center pole 17. A transverse cross section of the center pole 17 is of a T-shape when viewed along the longitudinal direction, and assumes an upside-down T-shape when the diaphragm 11 is faced up as shown in FIG. 1(*c*). Further, the center pole 17 has two side surfaces adjacent to the two respective bottom surfaces and extending in the longitudinal direction. Transverse cross sections of the top plates 18 are of rectangular shapes when viewed along the longitudinal direction, and the top plates 18 are fixed to the top surfaces of the respective magnets 16. The two side surfaces of the center pole 17 are each placed so as to oppose one longitudinal surface of the corresponding magnet 16 and one longitudinal surface of the corresponding top plate 18, with constant spaces maintained therebetween. These spaces serve as the magnetic gaps ("G" in FIG. 1(*c*)).

Figure 2:
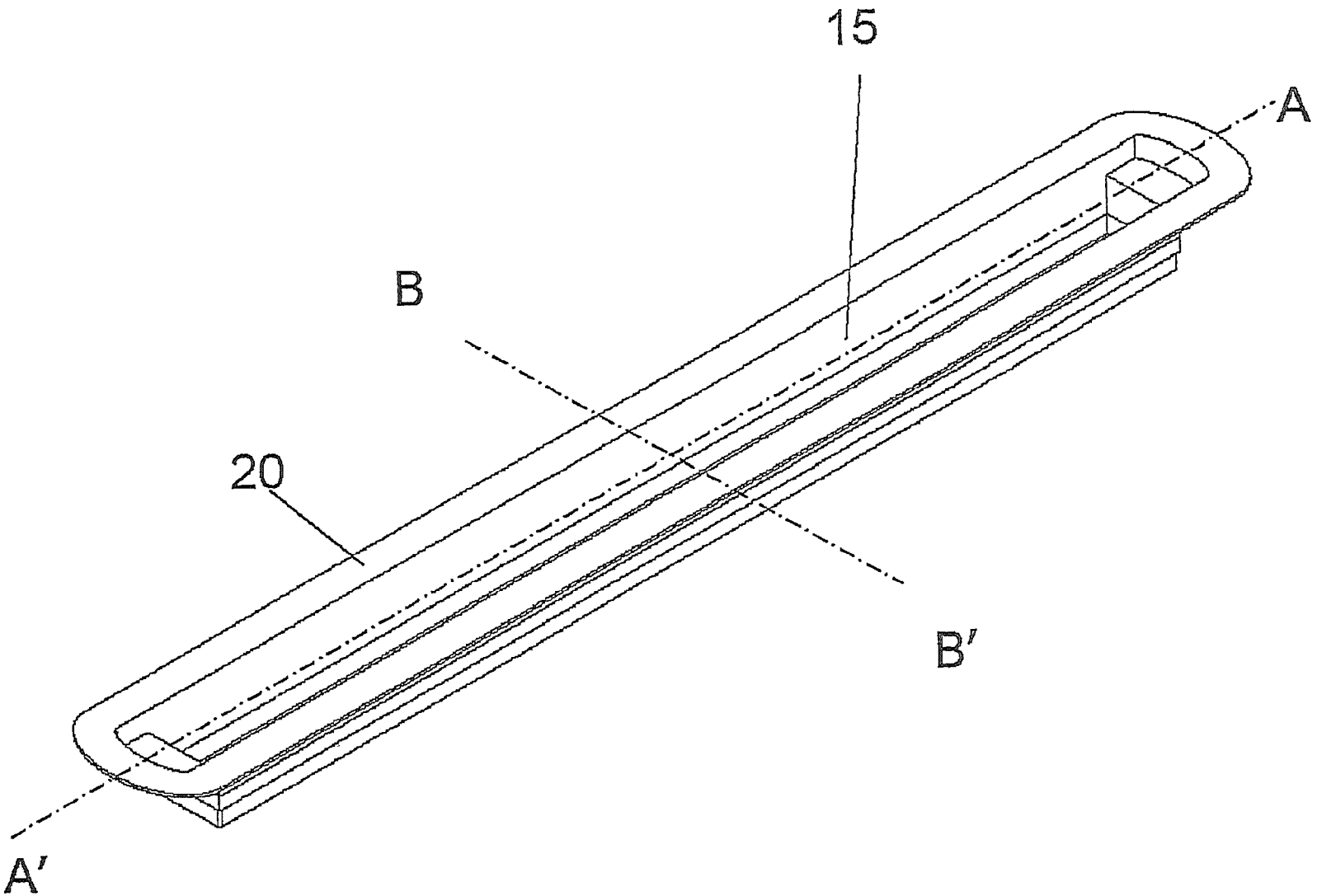
FIG. 2 is a perspective view of the appearance of a coupling cone 15.

FIG. 2 is a perspective view of the appearance of the coupling cone 15. As shown in FIG. 2, when viewed from the front direction (as viewed from above, in FIG. 2) in which sound waves are mainly emitted, the outline shape of the coupling cone 15 is equivalent to that of the diaphragm 11, or is an elongated shape of a smaller size of the diaphragm 11.

The coupling cone 15 has the structure where the coupling cone 15 is fixed to the rear surface, of the diaphragm 11, as viewed from the emission direction of sound waves, and extends from the rear surface, such that center lines X of the coupling cone 15 and the diaphragm 11 coincide with each other. The longitudinal directions of the coupling cone 15 and the diaphragm 11 are generally parallel to each other, and the coupling cone 15 vibrates in conjunction with the diaphragm 11.

Figure 3:
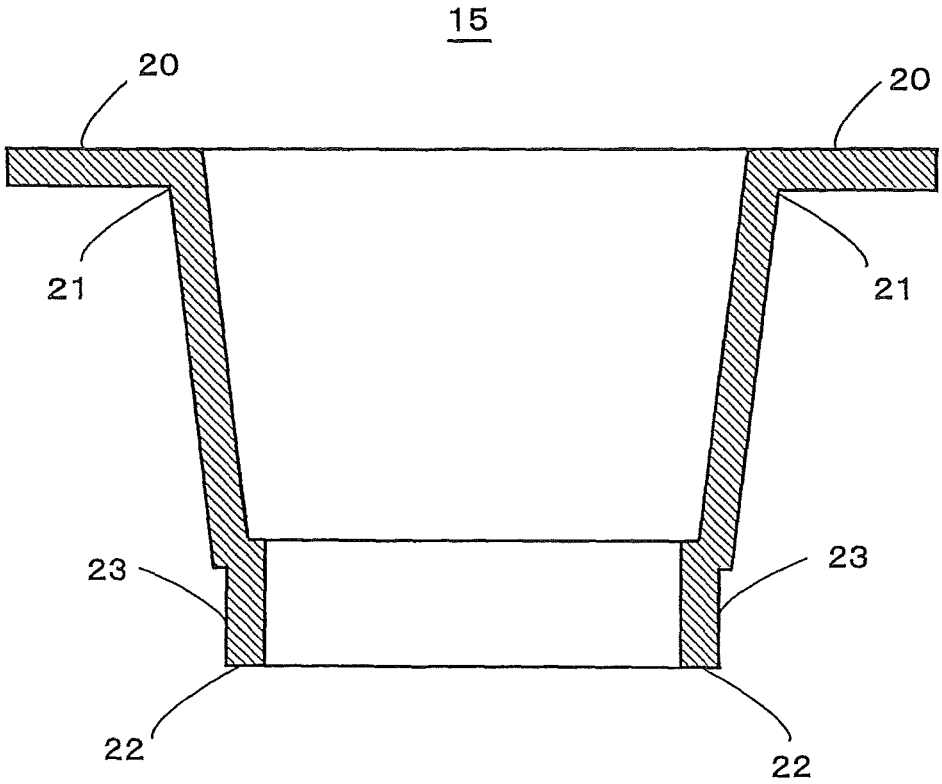
FIG. 3 is a cross-sectional view of the coupling cone 15 taken in a transverse direction B-B' shown in FIG. 2.

FIG. 3 is a cross-sectional view of the coupling cone 15 taken in a transverse direction B-B' shown in FIG. 2. In the cross section shown in FIG. 3, flanges 20 serve as flaps provided so as to increase the area of adhesion between the coupling cone 15 and the diaphragm 11 to thereby improve the adhesiveness therebetween. Further, with reference to this cross section, the two portions extending from root positions 21 (the upper ends, in FIG. 3) to end positions 22 (the lower ends, in FIG. 3) are elongated portions, respectively, that are parallel to the longitudinal direction of the diaphragm 11, the root positions 21 being closest to the rear surface of the diaphragm 11 and the end positions 22 being furthest from the rear surface of the diaphragm 11. The distance between the two elongated portions is smaller at the end positions 22 than at the root positions 21. Thus a transverse cross section of the coupling cone 15 is of an inverted trapezoidal shape, except for the flanges 20. Furthermore, in the vicinities of the end positions 22, fitting sections 23 are provided, into which the voice coil 14 is inserted so as to be fixed thereto. The voice coil 14 is fixed to the fitting sections 23. Thus the vibrations imparted to the voice coil 14 by the open-type magnetic circuit are transmitted to the diaphragm 11 through the coupling cone 15.

Similarly to the diaphragm 11 and the edge 12, the following are suitable for the material of the coupling cone 15: paper; lightweight, high rigidity metal foil formed of, for example, aluminum or titanium; polymer film formed of, for example, polyimide; or the like. Note that the coupling cone 15 may be formed of a different material from, or the same material as, those of the diaphragm 11 and the edge 12. Alternatively, the diaphragm 11 and the coupling cone 15 may be integrally molded of the same material, or the diaphragm 11, the edge 12, and the coupling cone 15 may be integrally molded of the same material.

Here, the voice coil 14 is placed within the magnetic gaps G. The two elongated portions of the coupling cone 15 are of such shapes and sizes that the entire two elongated portions, extending from the root positions 21 to the end positions 22, are included within the magnetic gaps G, respectively, when the coupling cone 15 vibrates in conjunction with the diaphragm 11. Specifically, the end positions 22 of the coupling cone 15 are further from the center line X than side surfaces 24 (see FIG. 1(*c*)), on the respective magnetic gap G sides, of the center pole 17 are. Further, the root positions 21 of the coupling cone 15 are closer to the center line X than side surfaces 25 (see FIG. 1(*c*)), on the magnetic gap G sides, of the respective magnets 16 and top plates 18 are.

With the structure described above, the coupling cone 15 can vibrate without contacting the open-type magnetic circuit, even though the structure is such that the distance between the end positions is smaller than the distance between the root positions.

<Details of Positions at which Coupling Cone 15 is Fixed to Diaphragm 11>

The following is a description of the positions at which the coupling cone 15 is fixed to the diaphragm 11.

In the long side direction, the coupling cone 15 is fixed to the diaphragm 11 almost throughout the entire diaphragm 11 except for the end portions thereof. In the present embodiment, the longitudinal length of the coupling cone 15 is 60% or more of that of the diaphragm 11. That is, the coupling cone 15 is fixed to the diaphragm 11 at a portion corresponding to 60% or more thereof in the longitudinal direction.

In the transverse direction, the coupling cone 15 is fixed to the diaphragm 11 at the positions of the nodes of a first resonant mode in the transverse direction of the diaphragm 11. That is, the root positions 21, at which the long sides of the coupling cone 15 are fixed to the diaphragm 11, are substantially the same as the positions of the respective nodes of the first resonant mode in the transverse direction of the diaphragm 11. Specifically, for example, if the rigidity of the diaphragm 11 is higher than that of the edge 12 and the mass of the edge 12 is so small as to be neglected as is that of the diaphragm 11, the positions of the nodes of the first resonant mode in the transverse direction of the diaphragm 11 are the positions corresponding to 0.224 and 0.776, measured from the respective ends of the short side of the diaphragm 11, the length of the short side of the diaphragm 11 being 1. Note that here, only modes having an even number of nodal lines that contribute to sound pressure characteristics are taken into account, and the order of the modes is represented as first, second, third . . . . Further, in the transverse direction, the coupling cone 15 is of a shape that becomes wider upward from the voice coil 14 to the diaphragm 11, and therefore the transverse length of the voice coil 14 is slightly smaller than the distance between the nodes of the first resonant mode in the transverse direction of the diaphragm 11. Here, in view of the assembly variations of the diaphragm 11 in shape, weight, and the like, optimal positions in the transverse direction at which the coupling cone 15 is attached to the diaphragm 11 is normally in the range from 0.2 to 0.25 and in the range from 0.75 to 0.8, in the transverse direction of the diaphragm 11. Note that if the mass and the rigidity of the edge 12 are too large as compared to those of the diaphragm 11 to be neglected, the positions of the nodes of the first resonant mode in the transverse direction of the diaphragm 11 change from the positions described above, and therefore the fixing positions of the coupling cone 15 also need to be changed in accordance with the changed positions of the nodes.

As described above, in the longitudinal direction, the diaphragm 11 is driven in a portion corresponding to 60% or more thereof, which is approximately equal to the entire driving of the diaphragm 11. On the other hand, in the transverse direction, the diaphragm 11 is driven only at the positions of the nodes of the first resonant mode in the transverse direction of the diaphragm 11.

<Operation and Effect of Loudspeaker According to Present Invention>

(1) When current is applied to the voice coil 14, magnetic field is produced by the current and the open-type magnetic circuit, and then driving force is generated by the magnetic field so as to act on the voice coil 14.

(2) The generated driving force is transmitted to the diaphragm 11 through the coupling cone 15.

(3) The voice coil 14, the coupling cone 15, and the diaphragm 11, which form an integrated rigid body, make the same vibration movements.

(4) The vibrations of the diaphragm 11 cause sound to be emitted into space. Here, with the loudspeaker 10 according to the present embodiment, the positions at which the coupling cone 15 is fixed to the diaphragm 11 are limited to the positions described above, and thereby it is possible to effectively impart driving force to the diaphragm 11, and therefore possible to greatly suppress the resonances of the diaphragm 11.

Here, the following is a description of the longitudinal and transverse resonances of a simple flat diaphragm.

In the present invention, it is assumed that the aspect ratio of the diaphragm is 2:1 or more. A resonant frequency is in inverse proportion to the square of the length, and therefore the resonant frequency of a resonance generated in the transverse direction is calculated to be more than four times the resonant frequency of a resonance generated in the longitudinal direction.

In addition, in the present embodiment, the diaphragm is driven at the positions of the nodes of the first resonant mode in the transverse direction, and thereby the first resonant mode is suppressed and the reproduction bandwidth is extended to a second resonant mode that follows. The second resonant frequency in the transverse direction is four to five times the first resonant frequency in the transverse direction, and therefore the reproduction bandwidth is extended to a very high frequency.

Thus, overall, the reproduction bandwidth is extended to a high frequency that is 16 times a first resonant frequency in the longitudinal direction or more.

In practice, an edge is provided in the periphery of the flat diaphragm, and therefore a transverse resonant frequency is two to four times a longitudinal resonant frequency. Even in this case, the reproduction bandwidth is extended to 8 to up to 16 times the longitudinal resonant frequency.

<Effect of Shape of Coupling Cone 15>

When the diaphragm 11 vibrates, the coupling cone 15 serves to transmit driving force to the diaphragm 11, and also to prevent the diaphragm 11 and the open-type magnetic circuit from interfering with each other.

The diaphragm 11 generates a wide vibration range in the bass range. For example, in order to reproduce a sound pressure of 88 dB/m at 100 Hz using a loudspeaker having a nominal diameter of 8 cm, a vibration range of 4 mm (from zero to peak) or more is required.

Thus it is necessary to provide a distance of 4 mm or more between the rear surface of the diaphragm 11 and the top surface of the center pole 17.

On the other hand, the voice coil 14 needs to be placed within the magnetic gaps G, and therefore the coupling cone 15 is required so as to connect the diaphragm 11 and the voice coil 14 and certainly transmit driving force to the diaphragm 11. The voice coil 14 is fitted to the vicinities of the end positions 22 of the coupling cone 15.

As described above, a transverse cross section of the coupling cone 15 is basically of an inverted trapezoidal shape that becomes wider from the lower end side to the upper end side. The inverted trapezoidal shape in cross section of the coupling cone considerably improves the strength against lateral shift thereof as compared to a coupling cone of a simple rectangular parallelepiped shape. Consequently, it is possible to suppress the lateral (the direction orthogonal to the proper vibration direction) vibrations of the voice coil. When the coupling cone 15 of an inverted trapezoidal shape in cross section was compared to a coupling cone of a rectangular parallelepiped shape by a finite element method, it was found that in the modes in the lateral direction, a first resonant frequency increases from 307 Hz to 309 Hz, and a second resonant frequency increases from 575 Hz to 583 Hz. Thus, with the structure where the coupling cone is wider on the upper end side, it is possible to improve the rigidity of the entire driving structure.

<Ingenuity and Effect in Manufacture>

Normally, a loudspeaker is produced using a cylindrical voice coil bobbin. However, it is difficult to produce the very elongated rectangular voice coil 14 according to the present embodiment (assuming that a rectangular voice coil of, for example, 100 mm×8 mm is used so as to correspond to the shape of the loudspeaker according to the present embodiment), as in a conventional loudspeaker. The voice coil used in a conventional loudspeaker is formed by bringing a voice coil bobbin into firm contact with a cylindrical winding jig, pressing a voice coil wire on the bobbin while applying pressure thereto, and adhering the wire to the bobbin. In the case of using a cylindrical bobbin, when a voice coil wire is wound around the bobbin, it is possible to perform the winding process while evenly applying pressure to the bobbin. In the case of using a rectangular bobbin, however, a voice coil has long flat portions in the longitudinal direction, and therefore all the pressure applied to the flat portions when the winding is performed can be received only at both ends on the long side. Thus it is impossible to apply pressure inwardly against straight portions. This may impair the firm contact between the voice coil bobbin and the voice coil, and the voice coil may disengage. Further, if an attempt is made to force down the coil against the straight portions using the rectangular bobbin, space may be produced between the bobbin and the coil underneath, or the ends, on the opposite sides to the winding sides, of the voice coil bobbin may undulate and deform.

Accordingly, in the present embodiment, the windings of the voice coil 14 are independently formed into rectangular shape in advance, and fitted and adhered to the fitting sections 23 of the coupling cone 15 formed into a desired shape in advance. This process makes it possible that based on each component formed into the corresponding shape in advance, the coil is adhered to the fitting sections 23 in accordance therewith to thereby be firmly fixed thereto.

In addition, the coupling cone 15 has the structure where the coupling cone 15 becomes wider from the lower end side (the end positions 22) to the upper end side (the root positions 21), and therefore can be formed by pressure-molding polyimide, thin aluminum foil, or the like. Thus it is relatively easy to provide a highly accurate coupling cone.

<Thickness of Loudspeaker>

It is possible to reduce the thickness of the loudspeaker according to the first embodiment: by using a flat diaphragm; with the structure where the coupling cone 15 can vibrate greatly without contacting the magnetic gaps; and by using a planar voice coil as the voice coil so as to reduce the thickness of the coil. The total thickness of the loudspeaker according to the present embodiment is the sum of: a distance D1 of the diaphragm vibrating in a maximum vibration range in the front surface direction; a distance D2 (approximately equal to the distance between the rear surface of the diaphragm and the top surface of the center pole) of the diaphragm vibrating in the maximum vibration range in the rear surface direction; a distance D3 (approximately equal to the distance between the end positions 22 of the coupling cone 15 and the upper end of the center pole 17) of the voice coil 14 vibrating in the maximum vibration range; a distance D4 between the bottom surfaces of the center pole 17 and the lower end of the voice coil 14; and a thickness D5 of the lower end portion of the center pole 17.

In a conventional cone-shaped loudspeaker, first, a thickness Dc of the cone is required for ensuring rigidity. Second, since a damper is provided between an open-type magnetic circuit and the cone paper, the following are also required: a distance Dc between the lower end of the cone paper and the damper; and a maximum vibration range Dim between the damper and the open-type magnetic circuit at the bottom, so that the damper does not contact the open-type magnetic circuit. In the present embodiment, however, none of these features is required, and therefore it is possible to reduce the thickness of a loudspeaker to thereby provide a thin loudspeaker.

[First Variation]

In a first variation, a diaphragm 30 is used instead of the diaphragm 11 according to the first embodiment, the diaphragm 30 having a fitting groove.

Figure 4:
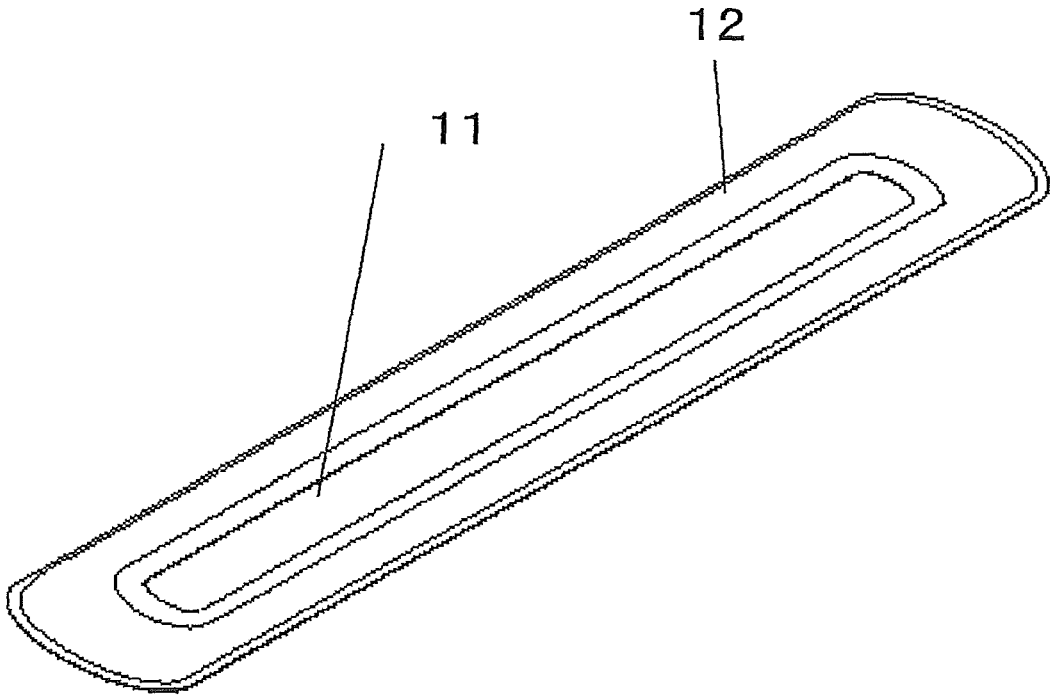
FIG. 4 is a perspective view of the appearance of a diaphragm 11 according to the first embodiment and an edge 12.

FIG. 4 is a perspective view of the appearance of the diaphragm 11 according to the first embodiment and the edge 12.

Figure 5:
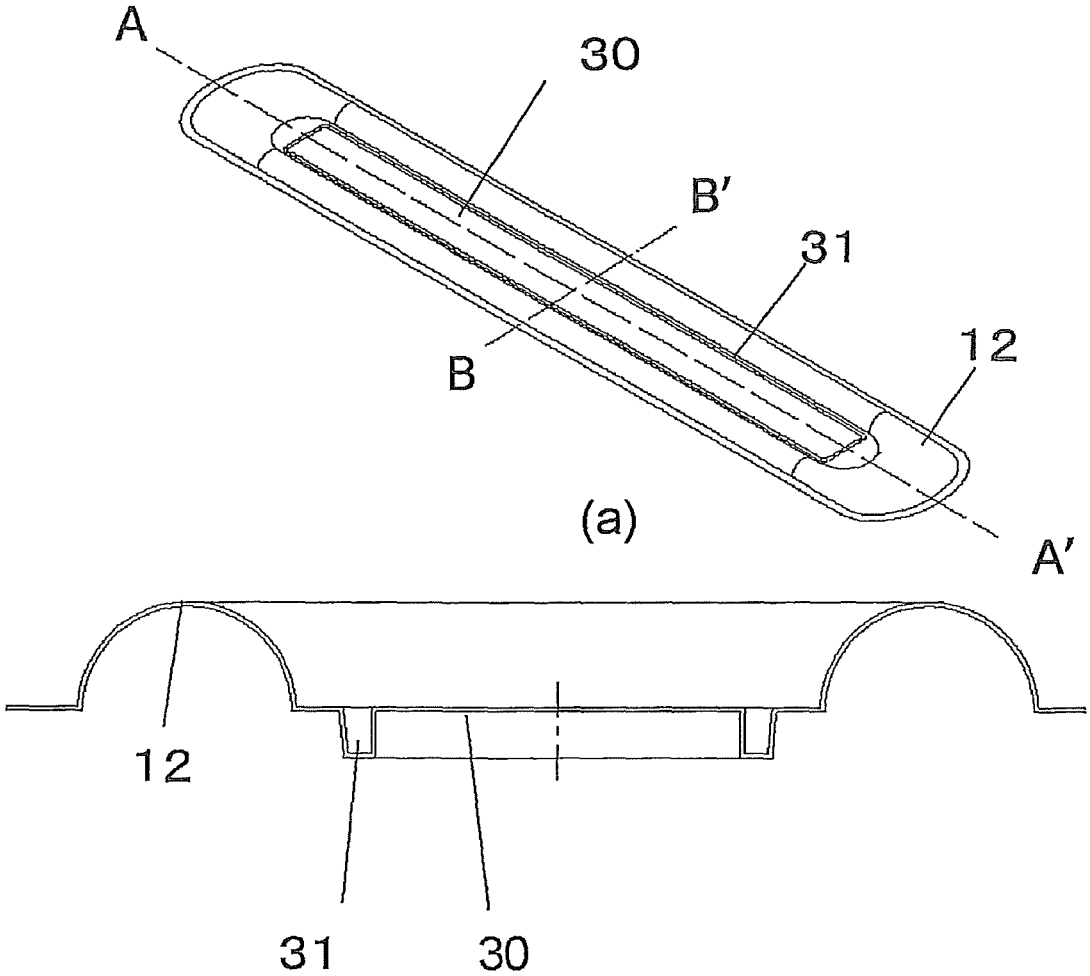
FIG. 5(*a*) is a perspective view of the appearance of a diaphragm 30 according to a first variation and the edge 12.

FIG. 5(*a*) is a perspective view of the appearance of the diaphragm 30 according to the first variation and the edge 12. FIG. 5(*b*) is a cross-sectional view (a cross section B-B') taken in the transverse direction of the diaphragm 30 and the edge 12.

In the first embodiment, the diaphragm 11 has a simple flat structure as shown in FIG. 4. In the first variation, as shown in FIG. 5(*a*) and (*b*), the diaphragm 30 has the structure where a fitting groove 31 is provided in the diaphragm 11 according to the first embodiment so as to improve the adhesiveness between the diaphragm and the coupling cone 15. This makes it possible to provide a highly durable loudspeaker.

[Second Variation]

In a second variation, a diaphragm 40 is used instead of the diaphragm 11 according to the first embodiment, the diaphragm 40 having reinforcing ribs.

Figure 6:
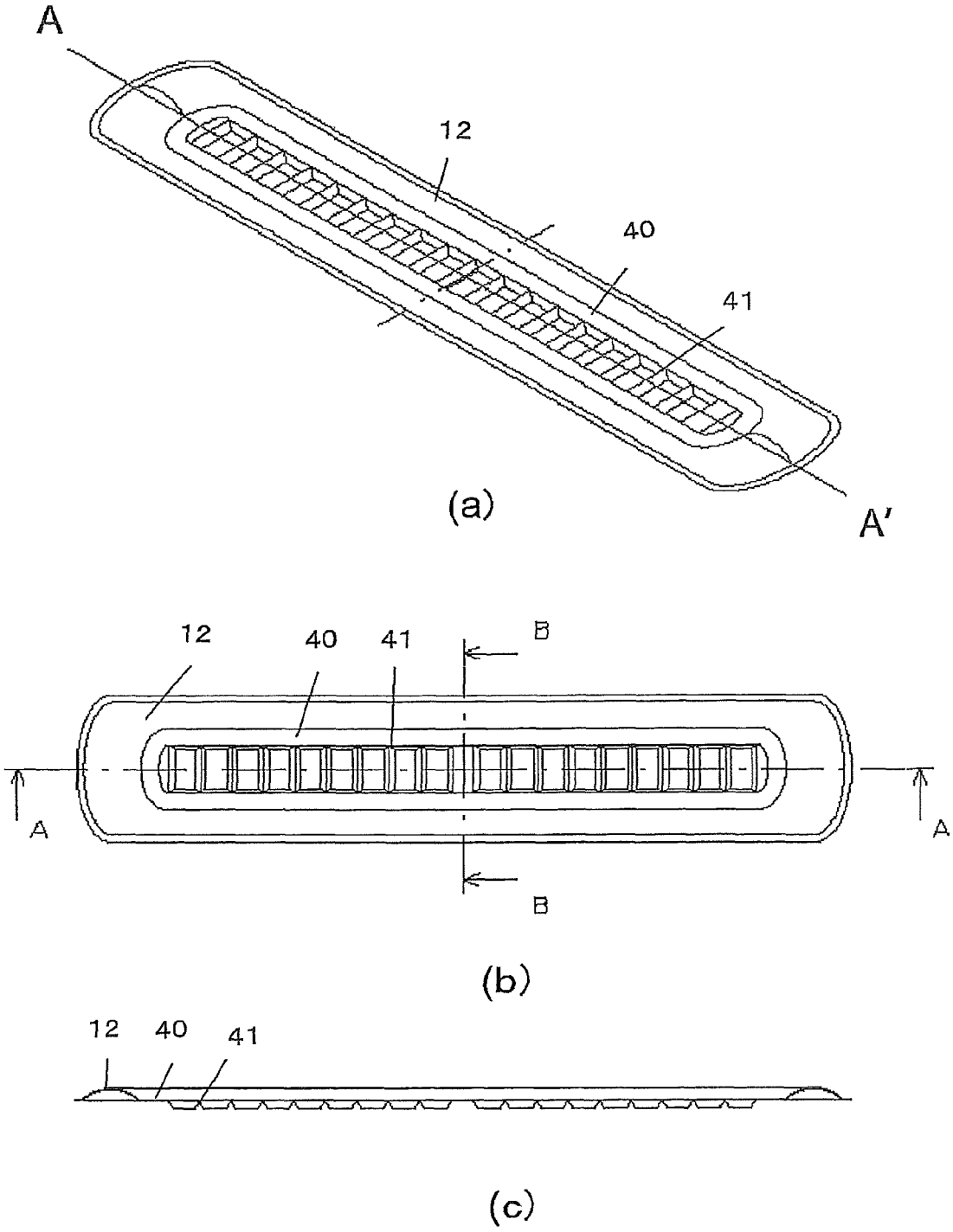
FIG. 6(*a*) is a perspective view of the appearance of a diaphragm 40 according to a second variation and the edge 12.

FIG. 6(*a*) is a perspective view of the appearance of the diaphragm 40 according to the second variation and the edge 12. FIG. 6(*b*) is a diagram showing the diaphragm 40 and the edge 12, as viewed from the front direction (as viewed from above, in FIG. 6(*a*)) in which sound waves are mainly emitted. FIG. 6(*c*) is a cross-sectional view (a cross section A-N) taken in the longitudinal direction of the diaphragm 40 and the edge 12.

As shown in FIG. 6(*a*) through (*c*), the diaphragm 40 has the structure where reinforcing ribs 41 are provided in the diaphragm 11 according to the first embodiment at the portion to which the coupling cone 15 is connected and which is between the root positions 21, the reinforcing ribs 41 forming projections and depressions in the longitudinal direction. The reinforcing ribs 41 considerably improve the transverse rigidity, and therefore can increase a transverse resonant frequency. Thus the diaphragm 40 serves as a diaphragm that does not resonate at higher frequencies. This makes it possible to provide a loudspeaker capable of reproduction without distortion.

Note that it is also possible to simultaneously carry out the second variation and the first variation.

[Third Variation]

In a third variation, a coupling cone 51 is used instead of the coupling cone 15 according to the first embodiment, the coupling cone 51 having reinforcing ribs.

Figure 7:
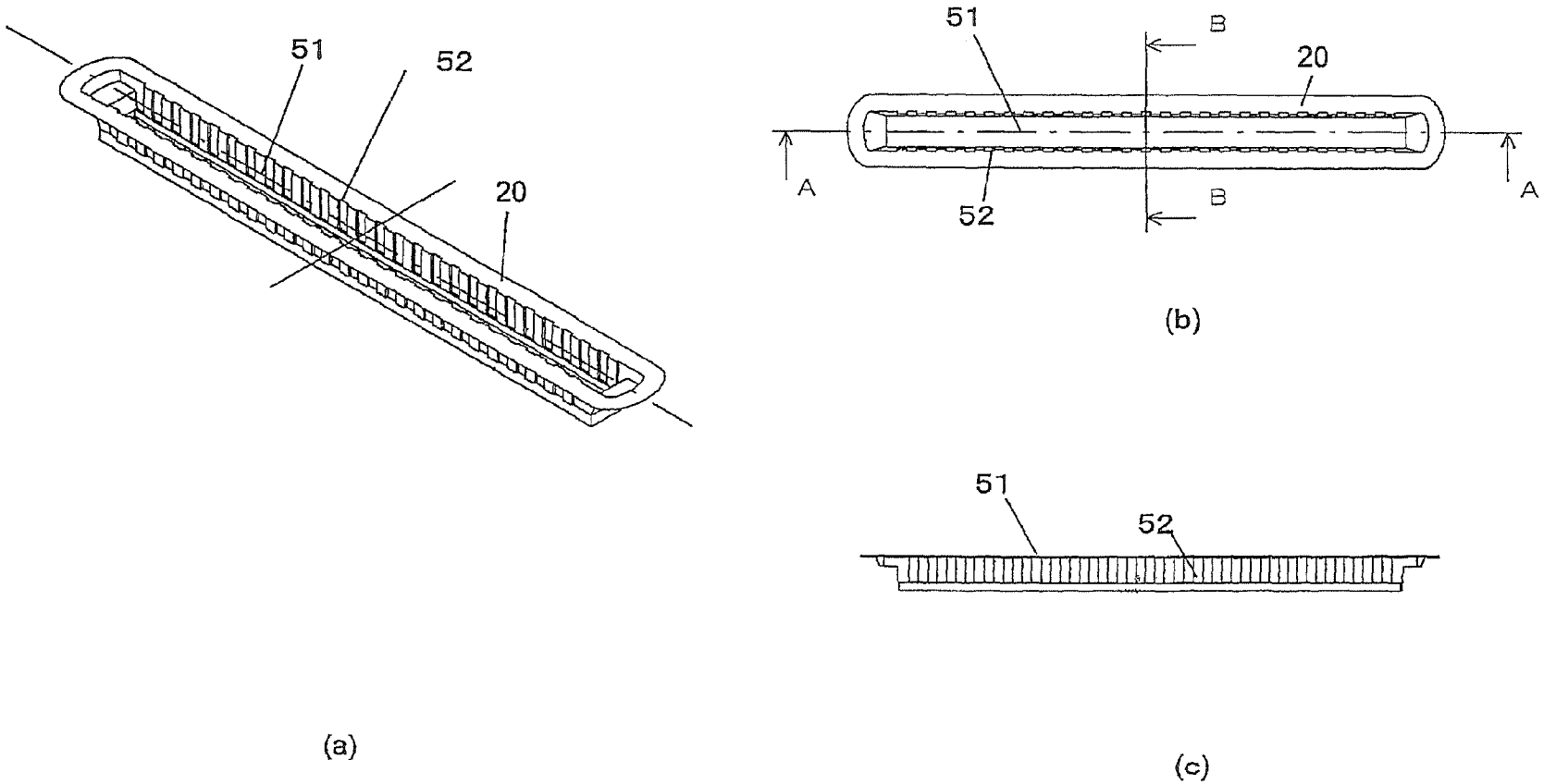
FIG. 7(*a*) is a perspective view of the appearance of a coupling cone 51 according to a third variation.

FIG. 7(*a*) is a perspective view of the appearance of the coupling cone 51 according to the third variation. FIG. 7(*b*) is a diagram showing the coupling cone 51, as viewed from the front direction (as viewed from above, in FIG. 7(*a*)) in which sound waves are mainly emitted. FIG. 7(*c*) is a side view of the coupling cone 51.

As shown in FIG. 7(*a*) through (*c*), the coupling cone 51 has the structure where reinforcing ribs 52 are provided almost throughout the entire two elongated portions (the inclined surfaces corresponding to the diagonal line portions of the inverted trapezoidal shape in cross section) of the coupling cone 15 according to the first embodiment, the reinforcing ribs 52 forming projections and depressions parallel to the longitudinal direction.

The reinforcing ribs 52 having projections and depression form a canapé structure, and therefore can improve the bending rigidity as compared to the case of using the inclined surfaces formed with simple flat surfaces. Thus the coupling cone 51 functions as in the case of increasing the thickness without increasing the weight, and therefore it is possible to prevent unwanted resonances of the coupling cone 51. Further, a buckling phenomenon does not occur, and therefore, even when a great driving force is transmitted, it is possible to prevent the weakening of output from occurring based on interference with the transmission of the driving force. Thus it is possible to realize reproduction with reduced distortion.

In addition, when the third variation is carried out simultaneously with either one or both of the first and second variations to thereby obtain a synergistically high rigidity, it is also possible to provide a loudspeaker with further reduced distortion.

[Fourth Variation]

In a fourth variation, a coupling cone 61 is used instead of the coupling cone 15 according to the first embodiment, the material of the coupling cone 61 having air permeability.

Figure 8:
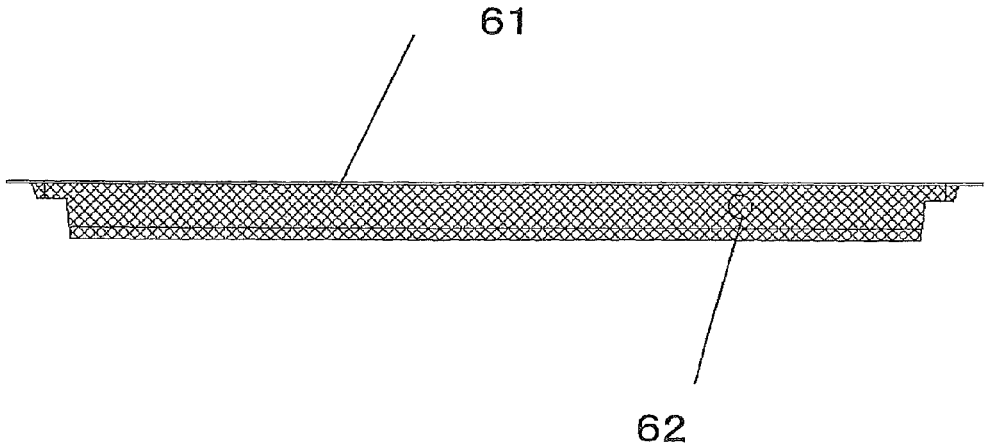
FIG. 8 is a side view of the appearance of a coupling cone 61 according to a fourth variation.

FIG. 8 is a side view of the appearance of the coupling cone 61 according to the fourth variation.

As shown in FIG. 8, the coupling cone 61 is similar in shape to the coupling cones according to the first embodiment and the third variation.

The coupling cone 61 is formed of an air-permeable material, and for example, is formed by molding a material, obtained by impregnating cloth with phenolic resin or acrylic resin, into a cone shape by heat curing.

Figure 9:
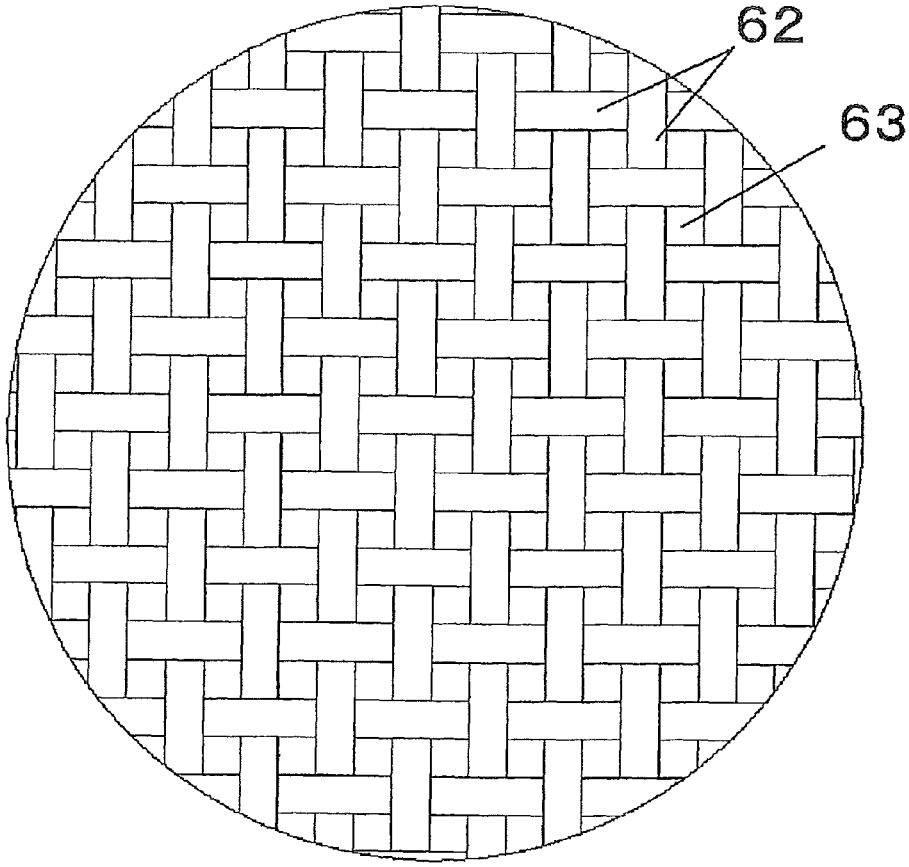
FIG. 9 is a magnified view of the surface of the coupling cone 61.

FIG. 9 is a magnified view of the surface of the coupling cone 61.

As shown in FIG. 9, twine 62 is interwoven, and air holes 63 are formed thereamong. As well as cloth, fine stainless mesh or the like may be used as the material to form the coupling cone 61. Similarly, a foil material having a large number of minute holes may be used.

As shown in FIG. 9, the fourth variation employs a mesh structure, and therefore has air permeability. Thus the air permeability makes it possible to suppress the generation of sound from the coupling cone 61 based on an acoustic load. Thus it is possible to suppress the generation of abnormal sound in high frequency bands based on the mechanical resonances of the diaphragm 11 and the coupling cone 61 itself. This makes it possible to provide a loudspeaker that ensures high sound quality. Further, adhesive flows into the mesh portion, which increases the area of adhesion, and therefore increases the adhesive force between the coupling cone 61, and the diaphragm 11 and the planar voice coil 14. This makes it possible to provide a highly durable loudspeaker.

In addition, when the fourth variation is carried out simultaneously with any one or some of the first through third variations where appropriate, it is also possible, with a synergistically high rigidity and a material not generating sound, to provide a loudspeaker with further reduced distortion.

[Second Embodiment]

A loudspeaker according to a second embodiment includes a plurality of open-type magnetic circuits arranged in the longitudinal direction, the open-type magnetic circuits having a shorter length of the open-type magnetic circuit of the loudspeaker according to the first embodiment, and also includes a damper between each adjacent pair of the open-type magnetic circuits, the damper supporting and allowing a coupling cone to easily vibrate in the emission direction of sound waves.

<Structure>

Figure 10:
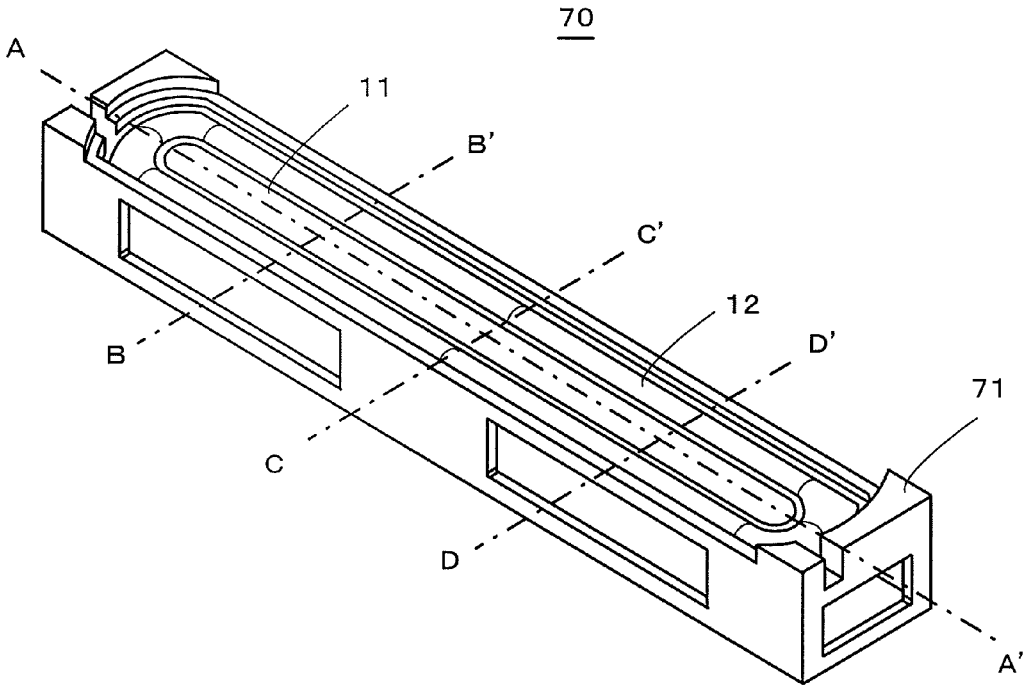
FIG. 10(*a*) is a perspective view of the appearance of a loudspeaker 70 according to a second embodiment.
Figure 10:
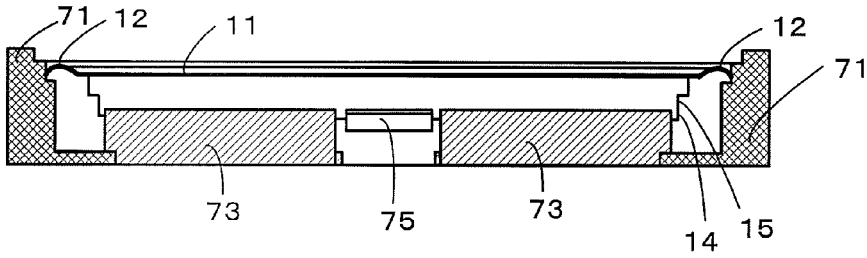
Figure 11:
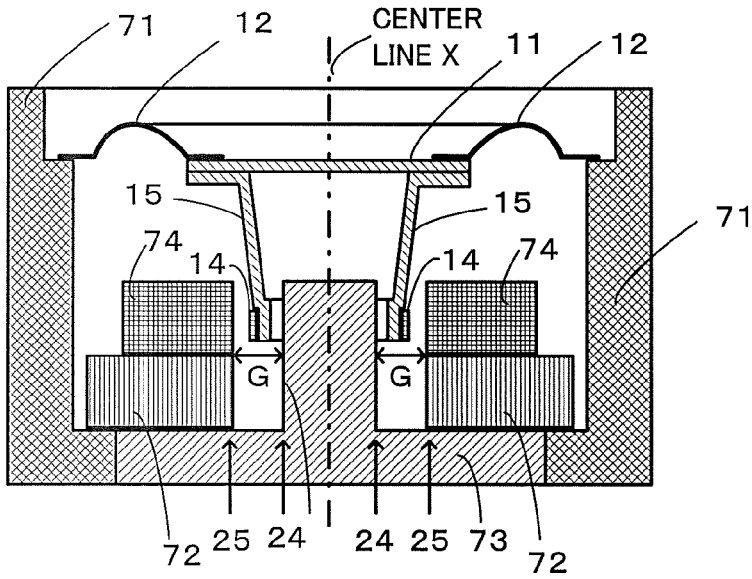
FIG. 11(*a*) is a cross-sectional view (a cross section B-B' and a cross section D-D') taken in the transverse direction, and at around the midpoints between the longitudinal ends and center, of the loudspeaker.
Figure 11:
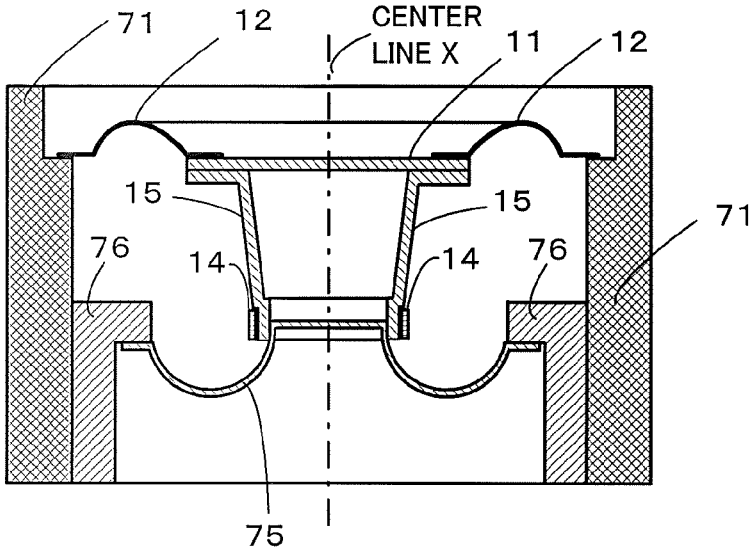

FIG. 10(*a*) is a perspective view of the appearance of a loudspeaker 70 according to the second embodiment. FIG. 10(*b*) is a cross-sectional view (a cross section A-A') taken in the longitudinal direction, and at an approximate center, of the loudspeaker. FIG. 11(*a*) is a cross-sectional view (a cross section B-B' and 'a cross section D-D') taken in the transverse direction, and at around the midpoints between the longitudinal ends and center, of the loudspeaker. FIG. 11(*b*) is a cross-sectional view (a cross section C-C') taken in the transverse direction, and at an approximate center, of the loudspeaker.

The loudspeaker 70 shown in FIG. 10(*a*) and (*b*) and FIG. 11(*a*) and (*b*) is a narrow loudspeaker of an elongated shape, whose longitudinal and transverse lengths differ from each other when viewed from the front direction (as viewed from above, in FIG. 10(*b*)) in which sound waves are mainly emitted. The loudspeaker 70 includes a diaphragm 11, an edge 12, a frame 71, a voice coil 14, a coupling cone 15, four magnets 72, two center poles 73, four top plates 74, a damper 75, and two damper mounting bases 76.

Note that in the second embodiment, the same components as those of the first embodiment are denoted by the same numerals, and are not described.

The frame 71 is of a loop shape having a large opening portion particularly on the front face thereof. Here, as shown in FIG. 11(*b*), the frame 71 is different from the frame 13 according to the first embodiment in the shape of the cross section taken in the transverse direction and at the approximate center.

As shown in FIG. 10(*b*), the two center poles 73 are arranged in the longitudinal direction. Each of the center poles 73, the corresponding two magnets 72, and the corresponding two top plates 74 form an open-type magnetic circuit and are fixed to the frame 71, so as to generate magnetic flux in magnetic gaps ("G" in FIG. 11(*a*)) and provide the voice coil 14, placed within the magnetic gaps, with driving force for generating sound waves. The magnets 72, the center poles 73, and the top plates 74 are of elongated shapes when viewed from the front direction. The magnets 72, the center poles 73, and the top plates 74 are placed such that the longitudinal direction of each coincides with the longitudinal direction of the diaphragm 11. Transverse cross sections of the magnets 72 are of rectangular shapes when viewed along the longitudinal direction, and the magnets 72 are fixed to the two bottom surfaces, respectively, that are formed by the frame 71 and the corresponding center pole 73. Cross sections of the center poles 73 are of T-shapes when viewed along the longitudinal direction, and assume upside-down T-shapes when the diaphragm 11 is faced up as shown in FIG. 11(*a*). Further, each of the center poles 73 has two side surfaces adjacent to the two respective bottom surfaces and extending in the longitudinal direction. Transverse cross sections of the top plates 74 are of rectangular shapes when viewed along the longitudinal direction, and the top plates 74 are fixed to the top surfaces of the respective magnets 72. The two side surfaces of each of the center poles 73 are each placed so as to oppose one longitudinal surface of the corresponding magnet 72 and one longitudinal surface of the corresponding top plate 74, with constant spaces maintained therebetween. These spaces serve as the magnetic gaps ("G" in FIG. 11(*a*)). Note that in the second embodiment, two open-type magnetic circuits are formed; however, the number of open-type magnetic circuits may be increased.

As shown in FIG. 11(*b*), the damper 75 is provided between a plurality of the open-type magnetic circuits arranged in the longitudinal direction. The damper 75 connects end positions 22 of the coupling cone 15 with the respective damper mounting base 76 at the approximate center in the longitudinal direction where neither of the open-type magnetic circuits is provided, and supports and allows the coupling cone 15 to easily vibrate in the emission direction of sound waves. Here, the damper 75 is placed such that center lines of the damper 75 and the diaphragm 11 coincide with each other. Further, around the damper 75 is a space where the damper 75 can vibrate, and rolls of the damper 75 are provided parallel to the long side direction of the diaphragm 11.

Figure 12:
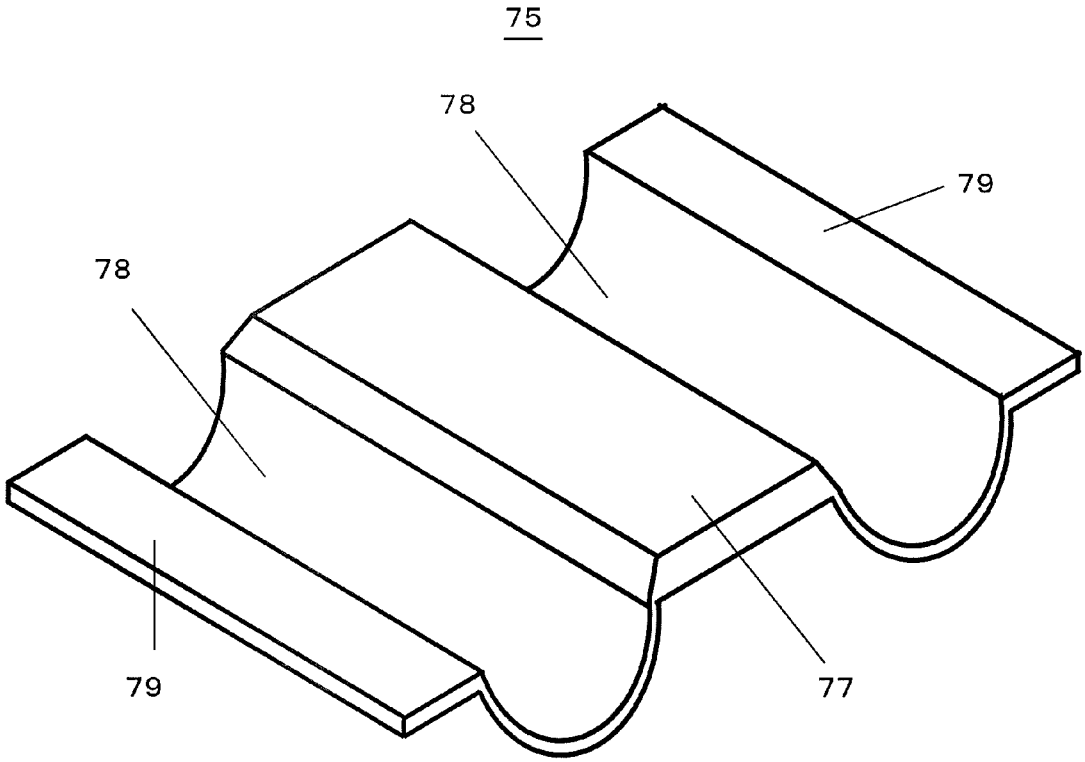
FIG. 12 is a detail perspective view of a damper 75.

FIG. 12 is a detail perspective view of the damper 75.

As shown in FIG. 12, the damper 75 has a reinforcing base 77 of a truncated pyramidal shape in the central portion thereof. Two opposite sides of the bottom surface of the reinforcing base 77 are connected to rolls 78, respectively, whose cross sections are of generally semicylindrical shapes. Further, the sides, further from the reinforcing base 77 than those connected to the reinforcing base 77, of the rolls 78 are connected to flat portions 79, respectively, of elongated plate shapes. Here, the reinforcing base 77, the rolls 78, and the flat portions 79 are integrally molded.

In addition, the reinforcing base 77 is fixed to part of the end positions 22 of the coupling cone 15.

The damper 75 is formed of an elastic and durable material, and for example, is formed by heat curing a material obtained by impregnating cloth with phenolic resin or melamine resin. Further, the following are suitable for the material of the damper 75: polymer film formed of, for example, polyimide or PEN; rubber; rubber-base elastomer film; or the like.

The damper mounting bases 76 are fixed in the vicinity of the approximate center in the longitudinal direction of the frame 71, and are fixed to the respective flat portions 79 of the damper 75.

<Operation and Effect of Damper 75>

The damper 75 supports and allows part of the end positions 22 of the coupling cone 15 to vibrate, and thereby can support and allow, with the edge 12, the diaphragm 11 and the coupling cone 15 to vibrate.

(1) When current is applied to the voice coil 14, magnetic field is produced by the current and the open-type magnetic circuits, and then driving force is generated by the magnetic field so as to act on the voice coil 14.

(2) The generated driving force is transmitted to the diaphragm 11 through the coupling cone 15.

(3) The voice coil 14, the coupling cone 15, and the diaphragm 11, which form an integrated rigid body, make the same vibration movements.

(4) The vibrations of the diaphragm 11 cause sound to be emitted into space. Here, with the loudspeaker 70 according to the present embodiment, the damper 75 has the rolls 78 extending parallel to the long side direction of the diaphragm 11, and therefore easily deforms and does not interfere with the perpendicular (the up-down direction, in FIG. 10(*a*) and (*b*) and FIG. 11(*a*) and (*b*)) vibrations of the diaphragm.

As described above, the loudspeaker 70 according to the second embodiment has the structure where an open-type magnetic circuit is divided in two, and the damper 75 is provided in the space between the divided open-type magnetic circuits. Thus the edge 12 can support the uppermost portion of the vibration system, and the damper 75 can support the lowermost portion of the vibration system.

Between the edge 12 and the damper 75, the diaphragm 11, the voice coil 14, and the coupling cone 15 are provided. This leads to the structure where the distance between two points supporting the vibration system is largest, and the center of gravity of the vibration system exists between the support points. This considerably improves the effect of preventing rollings, which are transverse vibrations.

In addition, neither the open-type magnetic circuits nor the bottom plate of the frame 71 is provided around the damper 75. Thus it is not necessary to be concerned about the interference of the damper 75 and the open-type magnetic circuits with each other based on vibrations, and therefore the driving range is wide. This makes it possible to easily realize a thin structure.

In the first embodiment, it is set forth that the inverted trapezoidal shape in cross section of the coupling cone considerably improves the strength against lateral shift thereof as compared to a coupling cone of a simple rectangular parallelepiped shape.

In the second embodiment, the damper 75 functions to further strengthen the effect of the inverted trapezoidal shape in cross section of the coupling cone. Specifically, the damper 75 fills part of the open face at the lower ends of the coupling cone 15, and thereby can prevent vibration deformation. Thus the effect of the inverted trapezoidal shape in cross section of the coupling cone acts synergistically with the effect of the filling of part of the open face at the lower ends of the coupling cone 15. Consequently, it is possible to greatly prevent the voice coil from vibrating in the lateral direction (the direction orthogonal to the proper vibration direction), and therefore possible to prevent the voice coil from contacting the magnetic gaps.

Note that it is also possible to combine the second embodiment with any one or some of the first through fourth variations where appropriate.

[Fifth Variation]

In a fifth variation, a damper 81 is used instead of the damper 75 according to the second embodiment, the damper 81 having a greater rigidity than that of the damper 75.

Figure 13:
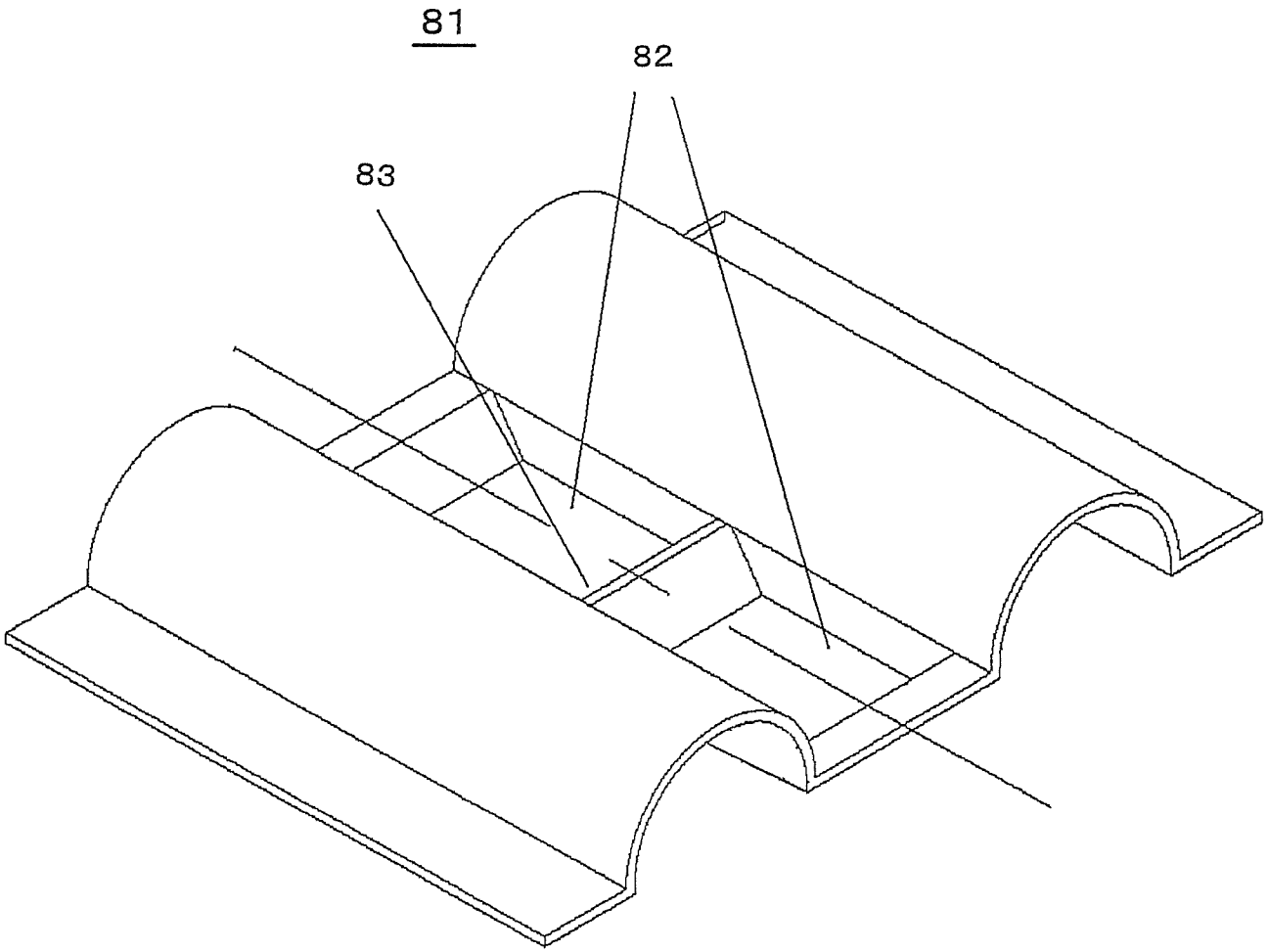
FIG. 13 is a perspective view of the appearance of a damper 81 according to a fifth variation.

FIG. 13 is a perspective view of the appearance of the damper 81 according to the fifth variation.

The damper 81 has the structure where the shape of the reinforcing base is changed to include a plurality of truncated pyramidal shapes, the reinforcing base being inserted into the fitting sections 23 of the coupling cone 15. FIG. 13 shows a reinforcing base 82 including two truncated pyramidal shapes.

The two truncated pyramidal shapes of the reinforcing base 82 form a reinforcing rib 83 between the two truncated pyramids, and therefore improve the rigidity against lateral deformation of the lower ends of the opening portion of the coupling cone 15. Thus it is possible to further prevent resonances.

Note that it is also possible to combine the fifth variation with any one or some of the first through fourth variations where appropriate.

[Sixth Variation]

In a sixth variation, a coupling cone 84 is used instead of the coupling cone 15 according to the second embodiment and the fifth variation, the coupling cone 84 having the structure where the end positions 22 are connected to each other by a connecting member 85 at the central portions, of the end positions 22, that do not interfere with the open-type magnetic circuits. Note that the connecting member 85 is integrally molded with the coupling cone 84.

Figure 14:
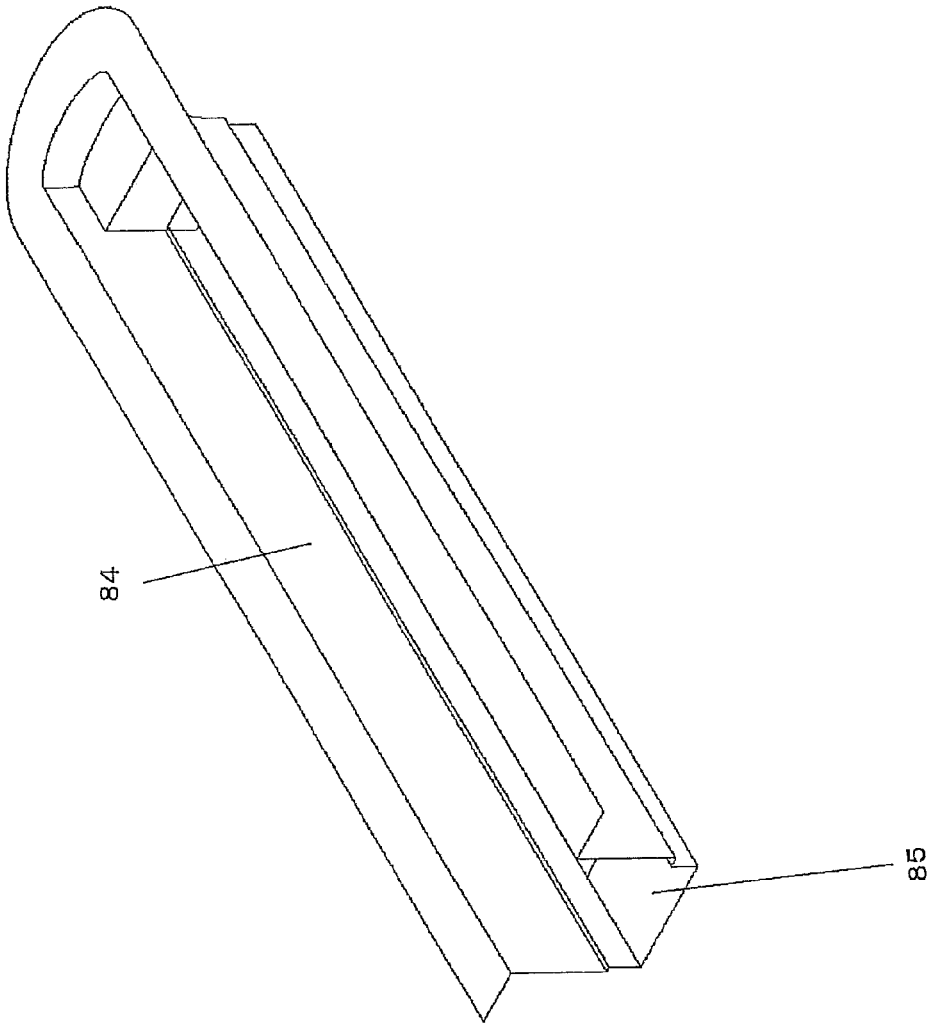
FIG. 14 is a perspective view of the appearance of a coupling cone 84 according to a sixth variation.

FIG. 14 is a perspective view of the appearance of the coupling cone 84 according to the sixth variation.

Figure 15:
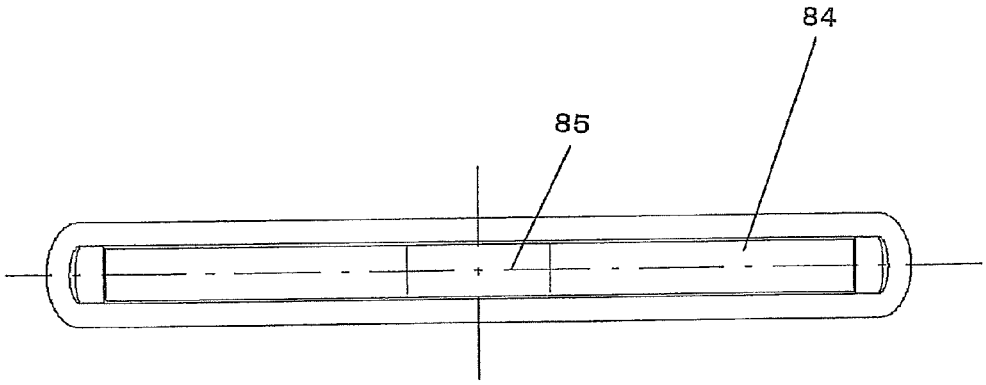
FIG. 15 is a diagram showing the coupling cone 84 shown in FIG. 14, as viewed from the front direction.

FIG. 15 is a diagram showing the coupling cone 84 shown in FIG. 14, as viewed from the front direction.

When the coupling cone 84 is combined with the damper 75 or and the damper 81, it is possible to greatly strengthen the structure of the connecting part, from a canapé structure to a thin-walled prismatic structure, and therefore possible to further improve the strength of the connecting part.

Note that it is also possible to combine the sixth variation with any one or some of the first through fourth variations where appropriate. [Third Embodiment]

In the second embodiment, a damper is provided between each adjacent pair of open-type magnetic circuits. A loudspeaker according to a third embodiment includes not only a damper between each adjacent pair of open-type magnetic circuits but also dampers at both longitudinal ends.

<Structure>

Figure 16:
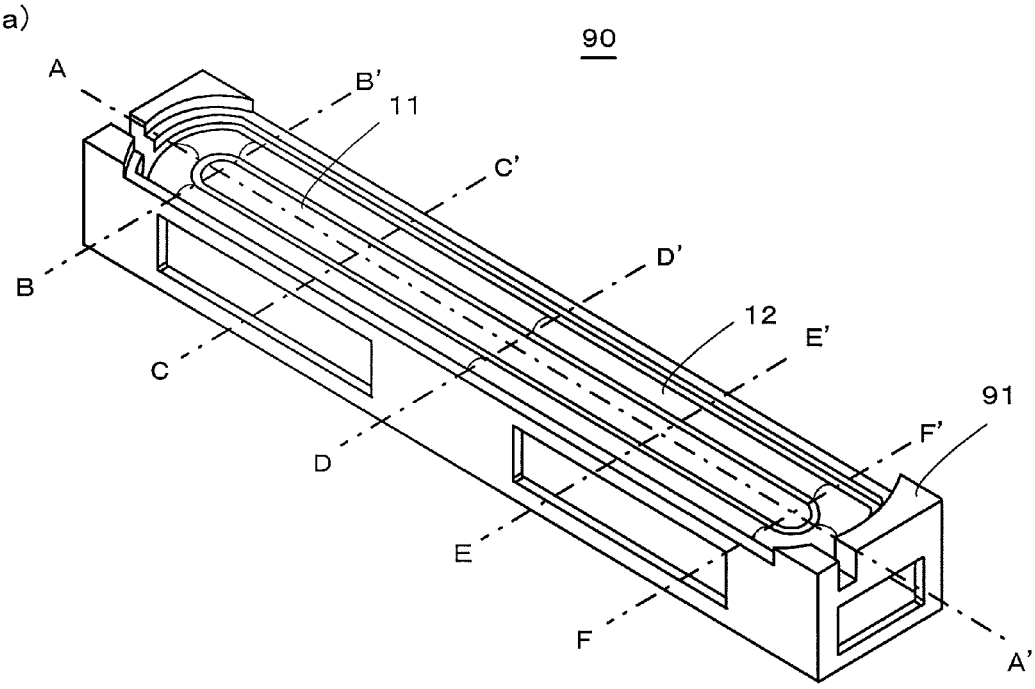
FIG. 16(*a*) is a perspective view of the appearance of a loudspeaker 90 according to a third embodiment.
Figure 16:
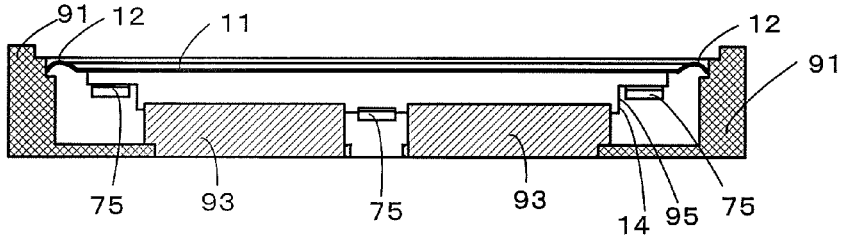
Figure 17:
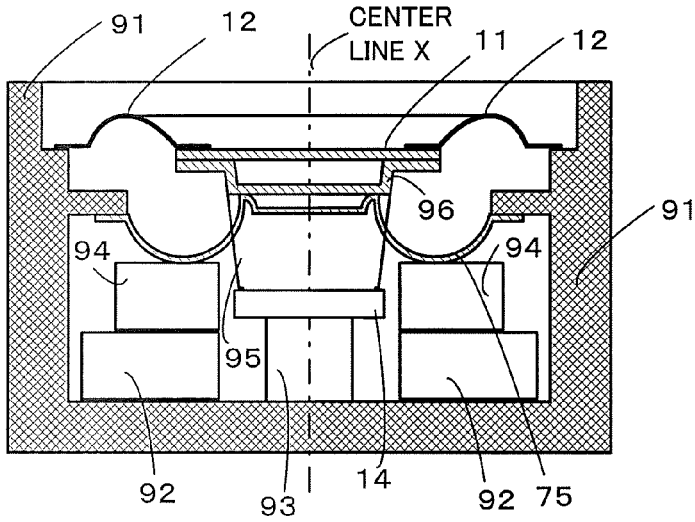
FIG. 17(*a*) is a cross-sectional view (a cross section B-B' and a cross section F-F') taken in the transverse direction, and at around the longitudinal ends, of the loudspeaker.
Figure 17:
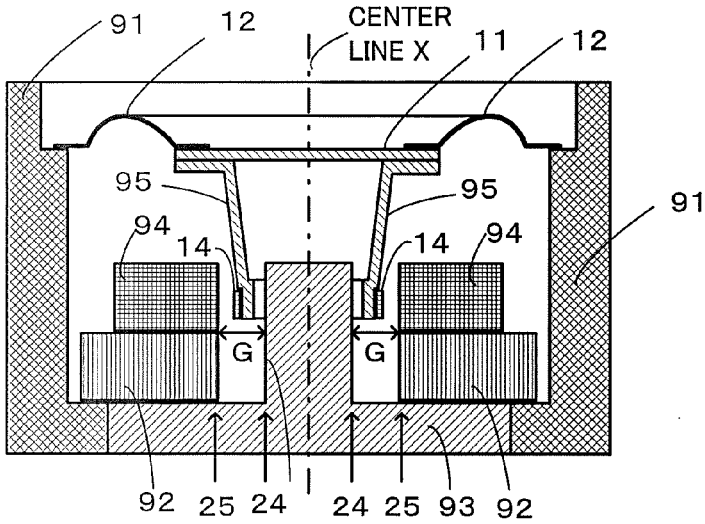
Figure 17:
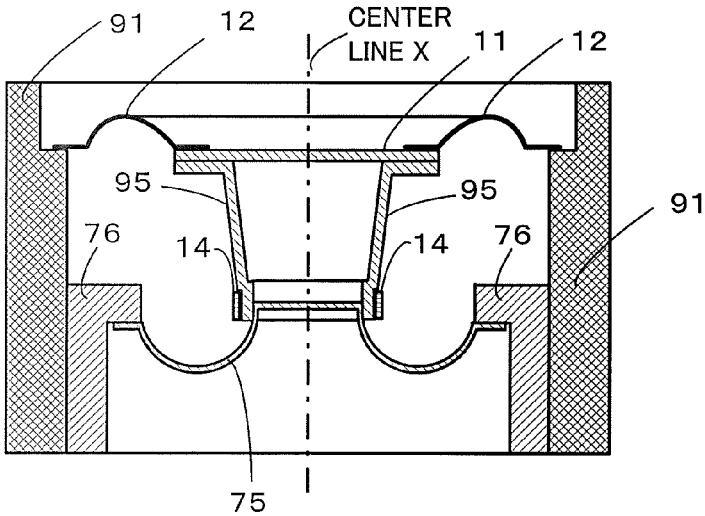

FIG. 16(*a*) is a perspective view of the appearance of a loudspeaker 90 according to the third embodiment. FIG. 16(*b*) is a cross-sectional view (a cross section A-A') taken in the longitudinal direction, and at an approximate center, of the loudspeaker. FIG. 17(*a*) is a cross-sectional view (a cross section B-B' and a cross section F-F') taken in the transverse direction, and at around the longitudinal ends, of the loudspeaker. FIG. 17(*b*) is a cross-sectional view (a cross section C-C' and a cross section E-E') taken in the transverse direction, and at around the midpoints between the longitudinal ends and center, of the loudspeaker. FIG. 17(*c*) is a cross-sectional view (a cross section D-D') taken in the transverse direction, and at an approximate center, of the loudspeaker.

The loudspeaker 90 shown in FIG. 16(*a*) and (*b*) and FIG. 17(*a*) through (*c*) is a narrow loudspeaker of an elongated shape, whose longitudinal and transverse lengths differ from each other when viewed from the front direction (as viewed from above, in FIG. 16(*b*)) in which sound waves are mainly emitted. The loudspeaker 90 includes a diaphragm 11, an edge 12, a frame 91, a voice coil 14, a coupling cone 95, four magnets 92, two center poles 93, four top plates 94, three dampers 75, and two damper mounting bases 76.

Note that in the third embodiment, the same components as those of the first and second embodiments are denoted by the same numerals, and are not described.

The frame 91 is of a loop shape having a large opening portion particularly on the front face thereof. Here, as shown in FIG. 17(*a*), the frame 91 is different from the frame 71 according to the second embodiment in the shape of the cross section taken in the transverse direction and at around the longitudinal ends.

As shown in FIG. 16(*b*), the two center poles 93 are arranged in the longitudinal direction. Each of the center poles 93, the corresponding two magnets 92, and the corresponding two top plates 94 form an open-type magnetic circuit and are fixed to the frame 91, so as to generate magnetic flux in magnetic gaps ("G" in FIG. 17(*b*)) and provide the voice coil 14, placed within the magnetic gaps, with driving force for generating sound waves. The magnets 92, the center poles 93, and the top plates 94 are only shorter in the longitudinal direction than the magnets 72, the center poles 73, and the top plates 74, respectively, according to the second embodiment, since the dampers 75 is provided at both ends, and all the other features are the same.

Note that in the third embodiment, two open-type magnetic circuits are formed; however, the number of open-type magnetic circuits may be increased.

The coupling cone 95 is different from the coupling cone 15 according to the first embodiment only in that the coupling cone 95 includes damper attaching bases 96 at both longitudinal ends, and all the other features are the same.

Similarly to the second embodiment, as shown in FIG. 17(*c*), one of the dampers 75 is provided between a plurality of the open-type magnetic circuits arranged in the longitudinal direction. In the third embodiment, as shown in FIG. 17(*a*), the other dampers 75 are further provided at both longitudinal ends on the sides of the open-type magnetic circuits, as between the open-type magnetic circuits. These other dampers 75 connect the frame 91 with the respective damper attaching bases 96, and support and allow the coupling cone 95 to easily vibrate in the emission direction of sound waves. Here, the dampers 75 are placed such that center lines of the dampers 75 and the diaphragm 11 coincide with each other. Further, around the dampers 75 are spaces where the dampers 75 can vibrate, and rolls of the dampers 75 are provided parallel to the long side direction of the diaphragm 11.

<Operation and Effect of Damper 75>

The damper 75 provided in the center is similar to that of the second embodiment.

The dampers 75 provided at both longitudinal ends can suppress, with improved strength, asymmetric vibrations (rollings) caused in the longitudinal direction, and therefore can support the diaphragm 11 and the coupling cone 95 with improved steadiness.

As described above, the loudspeaker 90 according to the third embodiment has the structure where an open-type magnetic circuit is divided in two, and the dampers 75 are provided in the space between the divided open-type magnetic circuits and provided at both longitudinal ends. Thus the edge 12 can support the uppermost portion of the vibration system, and the dampers 75 can support the lowermost portion of the vibration system.

Note that it is also possible to combine the sixth variation with any one or some of the first through sixth variations where appropriate.

In addition, it is also possible to combine the embodiments described above and the variations described above with one another where appropriate, so long as contradictions and conflicts do not arise.

[Analysis of Suppression of Longitudinal Resonant Modes]

The following is the result of analyzing the longitudinal driving length of the loudspeaker according to the present invention and the suppression effect on resonant modes, using a finite element method.

Figure 18:
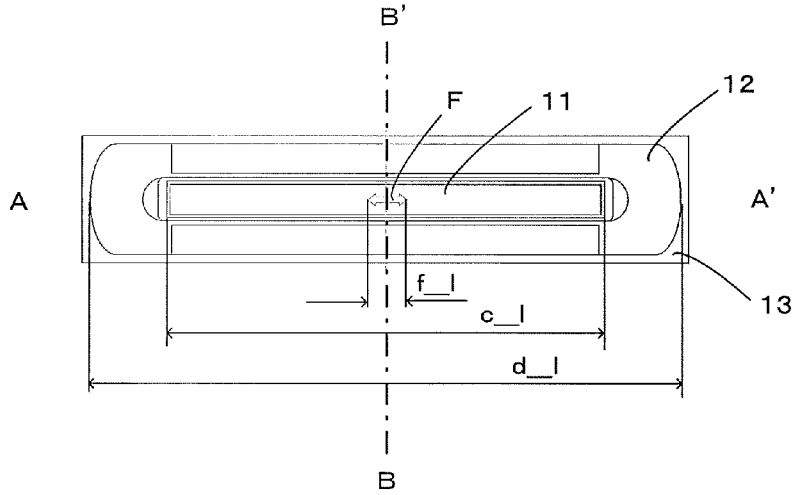
FIG. 18 is a diagram showing the loudspeaker 10 according to the first embodiment, as viewed from the front direction in which sound waves are mainly emitted.

FIG. 18 is a diagram showing the loudspeaker 10 according to the first embodiment, as viewed from the front direction in which sound waves are mainly emitted.

A driving force F is caused to act on the voice coil 14, and the length at which the driving force is imparted is represented by an arrow f_l shown in FIG. 18. The relationship between the length f_l and the frequency response of sound pressure level is examined by gradually increasing the length f_l. Here, the driving length is 0 when the driving force is imparted to only one point on a center line B-B'. Then the driving length is increased to a maximum length c_l of the voice coil.

In addition, the diaphragm used for the calculations is polyimide resin film 0.075 mm thick; a longitudinal length d_l of the entire vibrating portion including the edge 12 is 90 mm; and the length c_l of the voice coil portion is 65 mm. Thus the proportion of the driving length of the voice coil 14 in the diaphragm 11 is approximately 75%.

Figure 19:
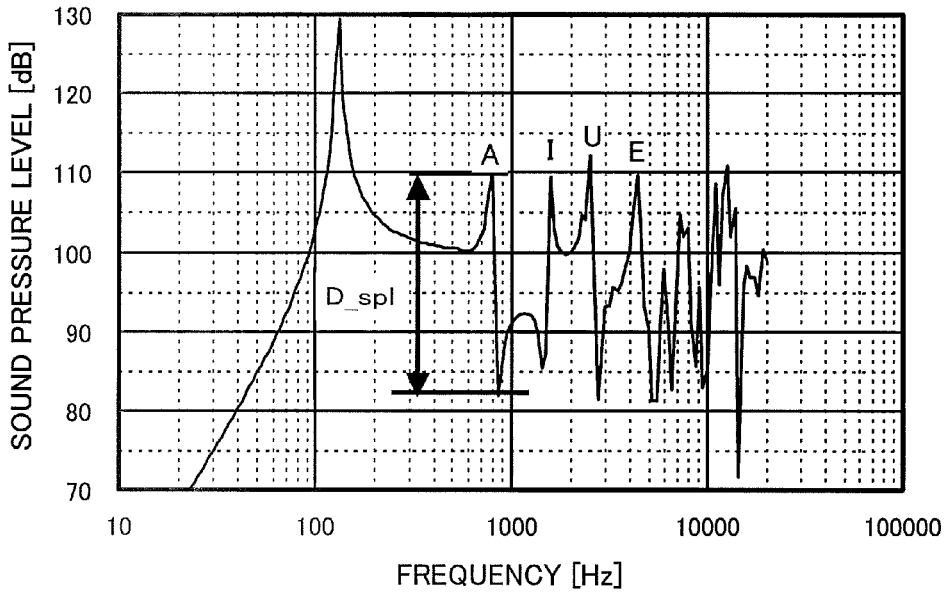
FIG. 19 is a diagram showing the result of calculating the frequency response characteristics of sound pressure level when driving is performed at only one point on a center line B-B' of FIG. 18.

FIG. 19 is a diagram showing the result of calculating the frequency response characteristics of sound pressure level when driving is performed at only one point on the center line B-B' of FIG. 18.

First large peak and dip occur at around a sound frequency of 800 Hz, represented by a point "A" in FIG. 19. Further, subsequently, large peaks and dips also occur: at around a sound frequency of 1600 Hz, represented by a point "I"; at around a sound frequency of 2300 Hz, represented by a point "U"; and at around a sound frequency of 4100 Hz, represented by a point "E". When the vibrational modes at these four points were closely examined, it was found that the vibrational modes at around the points "A", "I", and "E" are longitudinal resonant modes, and the vibrational mode at around the point "U" is a transverse resonant mode.

Figure 20:
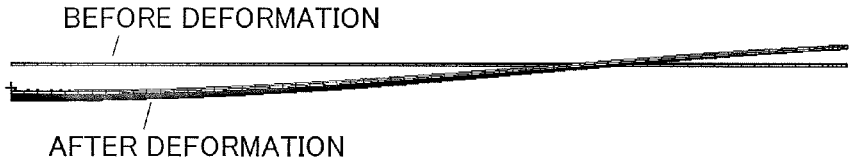
FIG. 20 is a diagram showing the vibrational mode of the diaphragm 11 at the sound frequency represented by a point "A" of FIG. 19.

FIG. 20 is a diagram showing the vibrational mode of the diaphragm 11 at the sound frequency represented by the point "A" of FIG. 19. The diaphragm 11 is symmetrical about the center line B-B' of FIG. 18, and therefore FIG. 20 corresponds to the shape of half the diaphragm 11. In FIG. 20, the left end corresponds to the center line B-B', and the right end corresponds to one of the longitudinal end of the voice coil 14. Referring to FIG. 20, when the shapes before and after deformation are compared, the central portion and the end portion vibrate greatly, and a nodal point is present therebetween. Thus the sound frequency represented by the point "A" indicates a first resonant mode in the longitudinal direction.

When the driving length f_l is gradually increased, the longitudinal vibrational modes are suppressed, and therefore the peaks and dips at around the points "A", "I", and "E" are considerably reduced.

Figure 21:
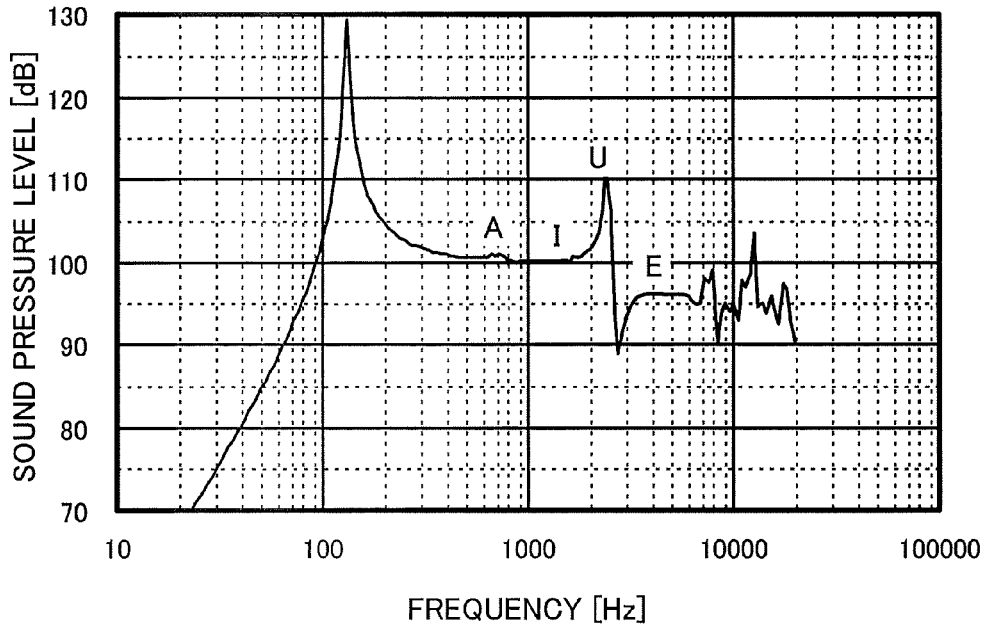
FIG. 21 is a diagram showing the result of calculating the frequency response characteristics of sound pressure level when driving is performed at the entire length of a voice coil.

FIG. 21 is a diagram showing the result of calculating the frequency response characteristics of sound pressure level when driving is performed at the entire length of the voice coil.

As shown in FIG. 21, when driving is performed at the entire length of the voice coil, the variations of sound pressure are generally reduced, and the peaks and dips based on the longitudinal vibrational modes are almost terminated. Thus the reproduction bandwidth is extended to the subsequent point "U", which corresponds to a transverse vibrational mode. Thus the increase of the longitudinal driving length and the integrated driving in the longitudinal direction suppress the longitudinal resonant modes.

In addition, the position, in the transverse direction, to which the driving force is imparted is set on not one line in the center but on two lines substantially the same as the positions of the nodes of the first resonant mode in the transverse direction of the diaphragm 11. Consequently, with the increasing driving length f_l, the first resonant mode in the transverse direction is suppressed and the peak and dip at around the point "U" are also considerably reduced.

When driving is performed at the entire length of the voice coil, not only the peaks and dips based on the longitudinal vibrational modes but also the peak and dip based on the first resonant mode in the transverse direction is almost terminated. Thus the reproduction bandwidth is extended past the point "E", which corresponds to a longitudinal vibrational mode, to a point (not shown) corresponding to the second vibrational mode in the transverse direction.

Figure 22:
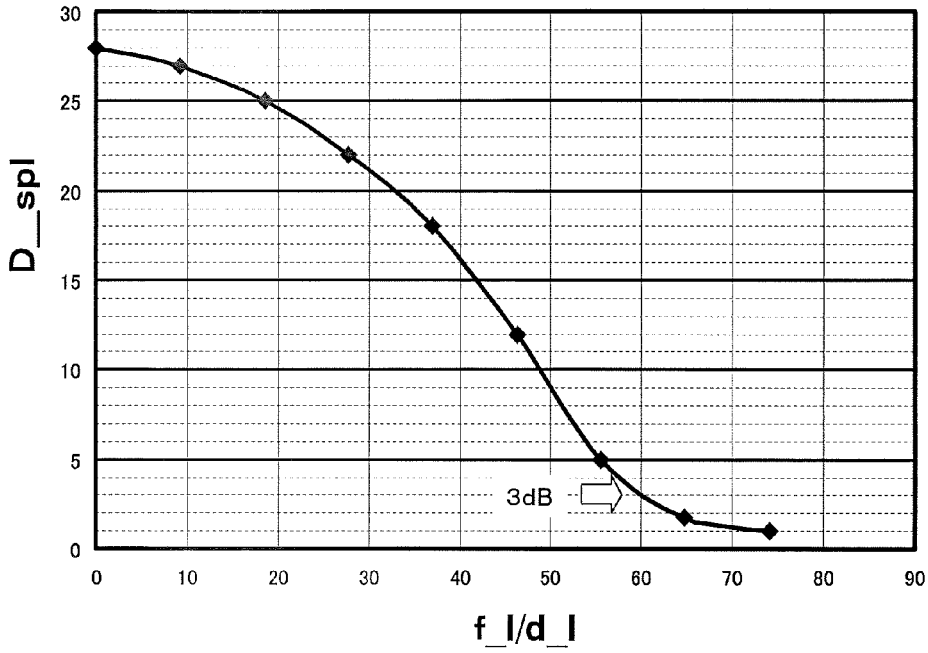
FIG. 22 is a diagram showing the relationship between a proportion "f_l/d_l" of the driving length, obtained from the analysis described above, in the entire length, and a sound pressure deviation "D_spl" (corresponding to "D_spl" in FIG. 19).

FIG. 22 is a diagram showing the relationship between a proportion "f_l/d_l" of the driving length, obtained from the analysis described above, in the entire length and a sound pressure deviation "D_spl" (corresponding to "D_spl" in FIG. 19).

As shown in FIG. 22, it is understood that when 60% or more of the entire diaphragm is driven, the sound pressure deviation falls within 3 dB, which is considered desirable.

[Verification of Effect]

Figure 23:
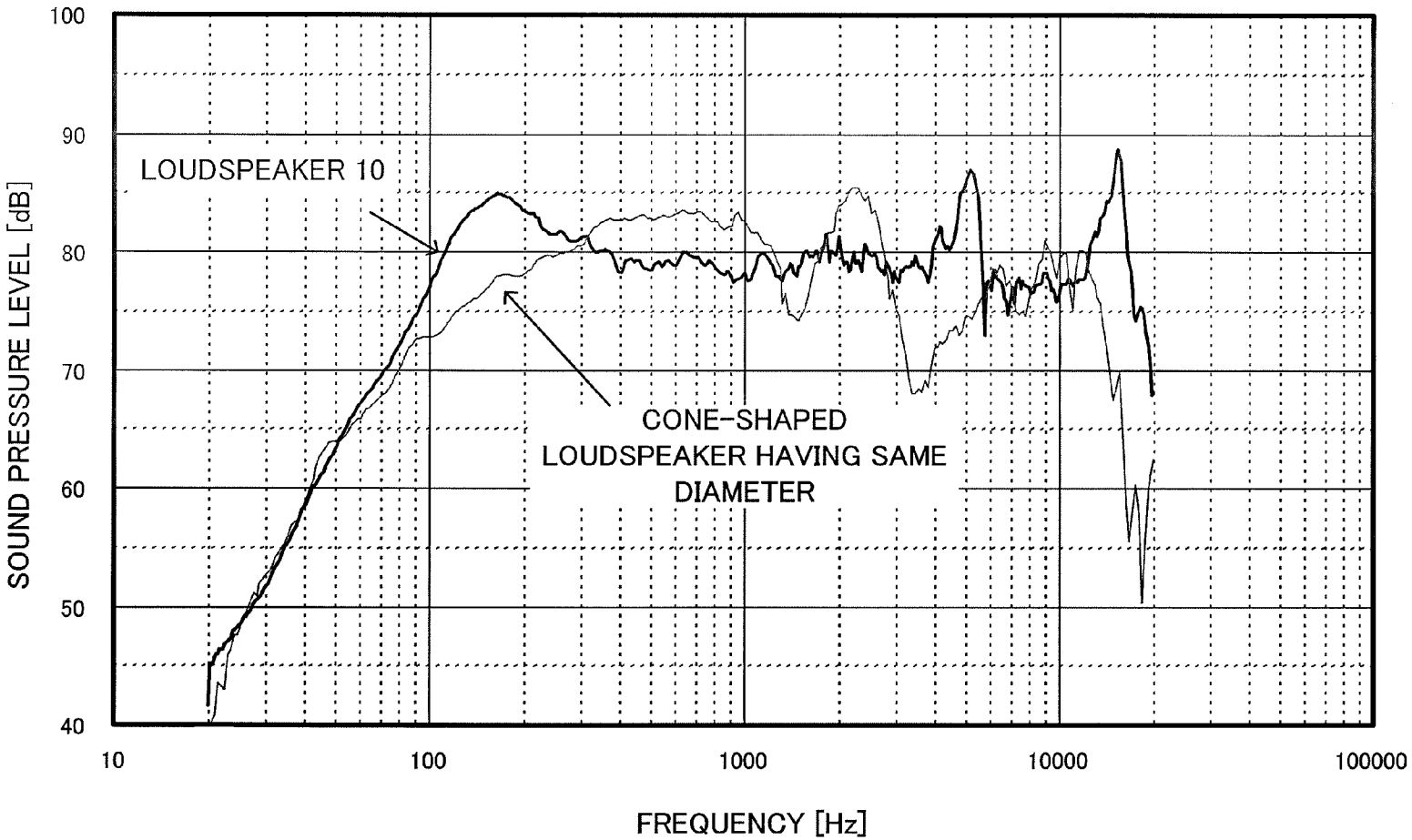
FIG. 23 is a diagram showing the result of verifying by actual measurement, and comparing, the JISBOX characteristics of the loudspeaker 10 according to the first embodiment and a cone-shaped loudspeaker having the same diameter.

FIG. 23 is a diagram showing the result of verifying by actual measurement, and comparing, the JISBOX characteristics of the loudspeaker 10 according to the first embodiment and a cone-shaped loudspeaker having the same diameter.

As shown in FIG. 23, the loudspeaker 10 according to the first embodiment generally has fewer variations of sound pressure than those of the cone-shaped loudspeaker having the same diameter, and has a wide range of frequencies at which sound pressure is relatively stable. Thus it can be said that the loudspeaker 10 is an excellent loudspeaker having high sound quality with a wide reproduction bandwidth.

As described above, the loudspeaker according to the present invention is capable of suppressing break-up resonances and has high sound quality even with its elongated and thin structure, and therefore is effective particularly if incorporated in an electronic device.

Figure 24:
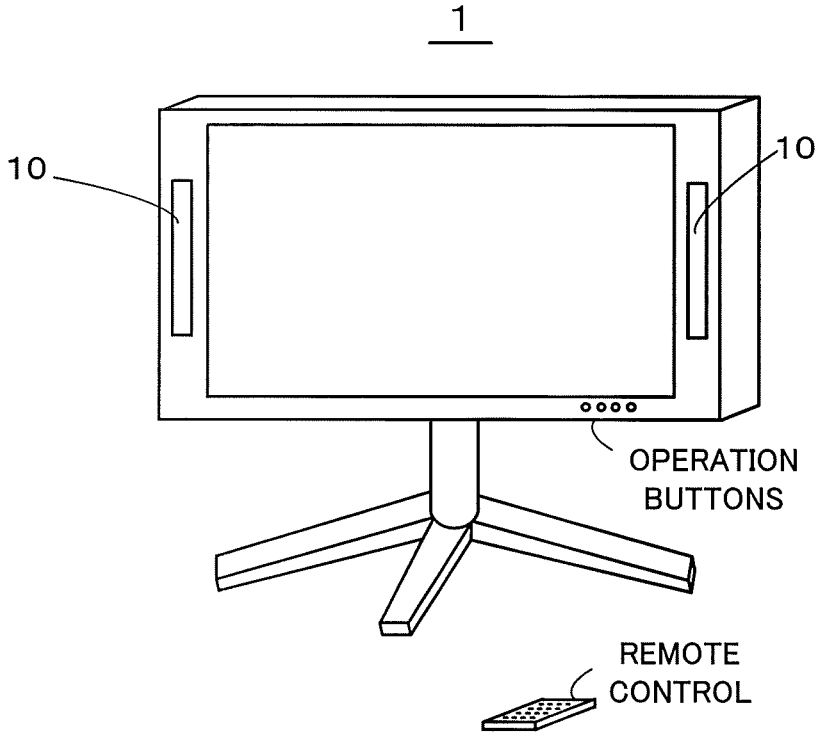
FIG. 24 is a diagram showing a television 1 having mounted therein the loudspeaker according to the present invention.

FIG. 24 is a diagram showing a television 1 having mounted therein the loudspeaker according to the present invention.

As shown in FIG. 24, the television 1 is a thin television such as a liquid crystal television or a plasma television, and includes any one type (the loudspeaker 10, in FIG. 24) of the loudspeaker according to the present invention on both sides of the screen.

Figure 25:
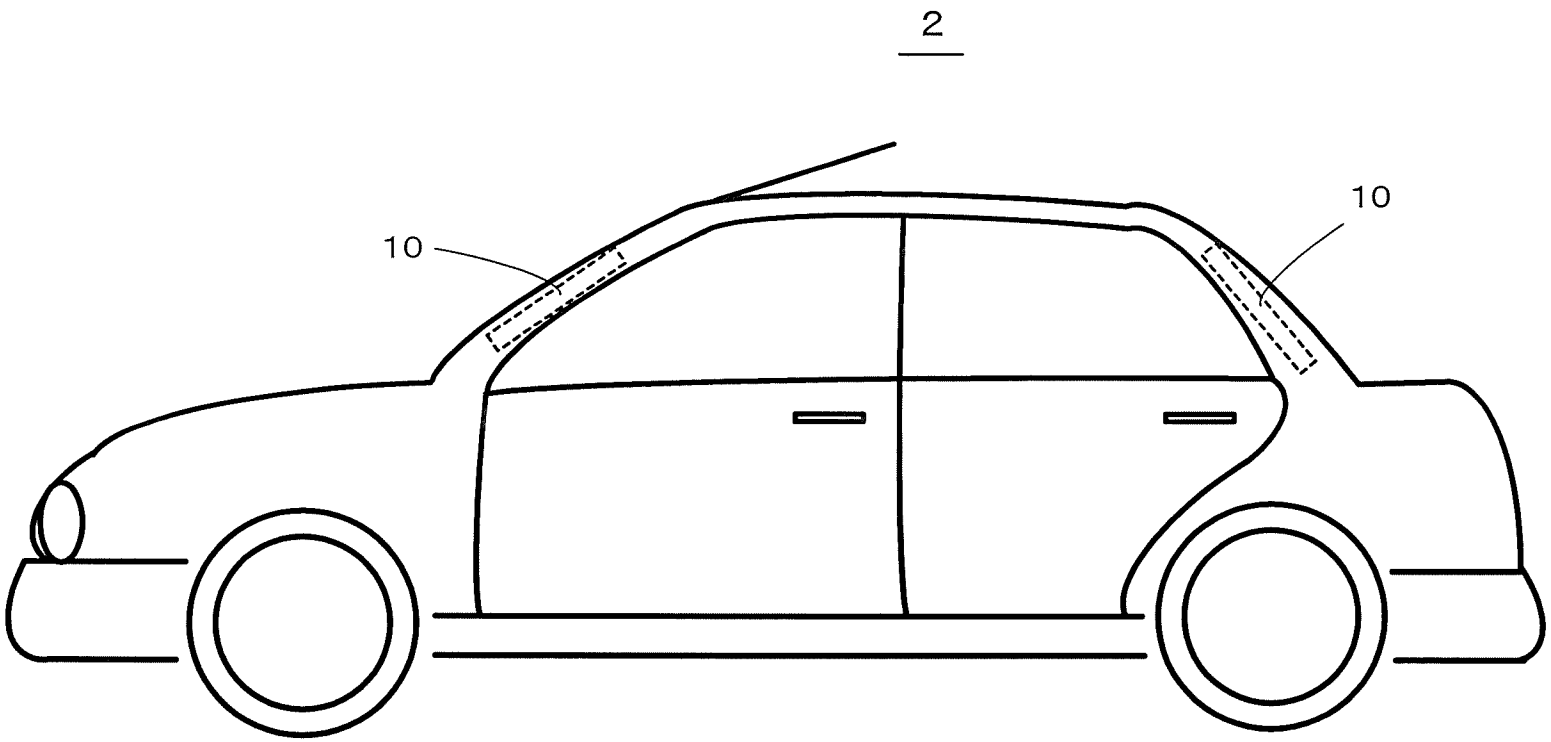
FIG. 25 is a diagram showing an automobile 2 having mounted therein the loudspeaker according to the present invention.
Figure 26:
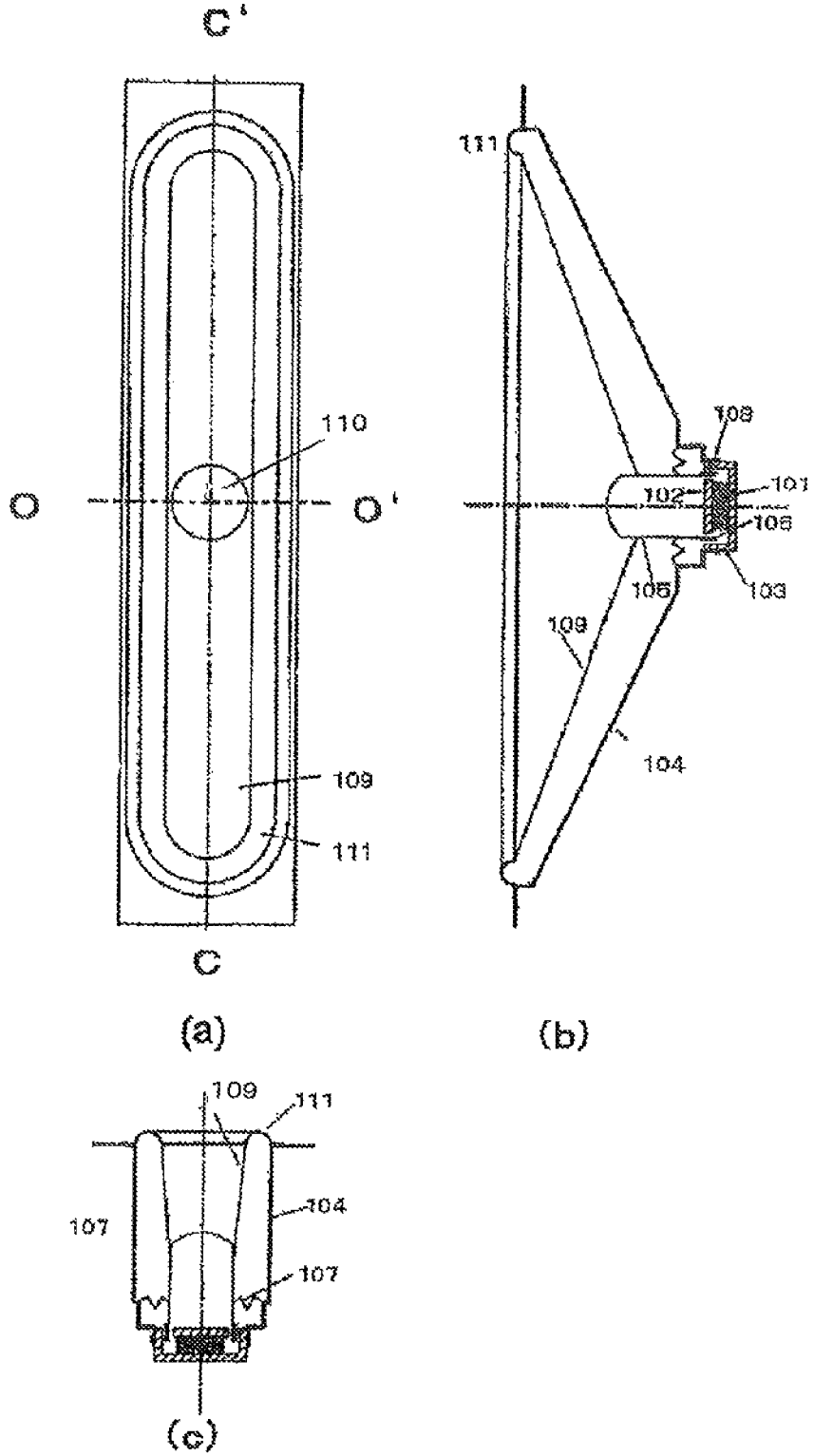
FIG. 26 PRIOR ART
FIG. 26(*a*) through (*c*) is a diagram showing the structure of a conventional narrow loudspeaker.
Figure 27:
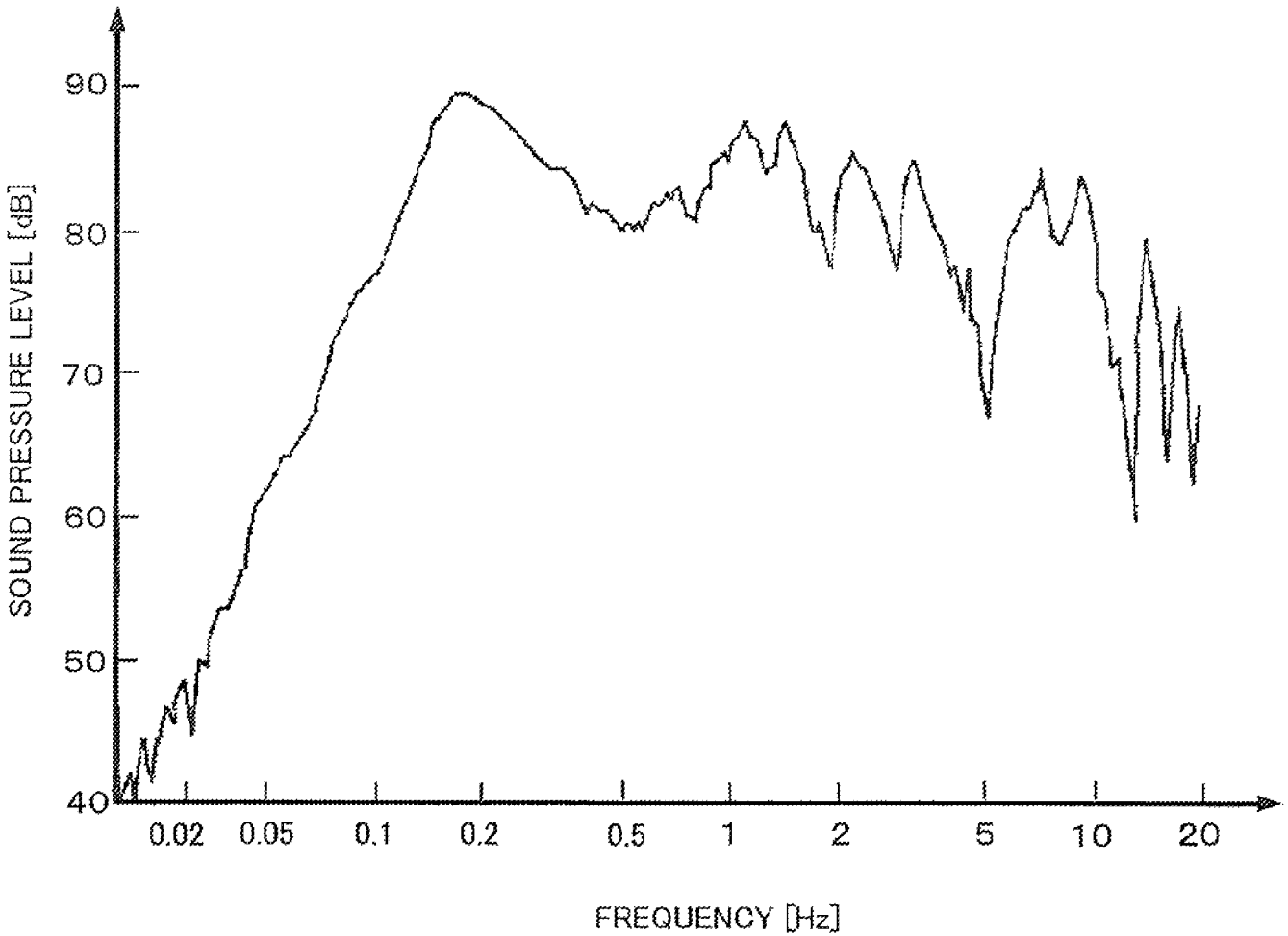
FIG.27 PRIOR ART
FIG. 27 is a diagram showing the frequency characteristics of the reproduction sound pressure level of a conventional narrow loudspeaker disclosed in Patent Literature 1.

FIG. 25 is a diagram showing an automobile 2 having mounted therein the loudspeaker according to the present invention.

As shown in FIG. 25, the automobile 2 includes any one type (the loudspeaker 10, in FIG. 25) of the loudspeaker according to the present invention, in front left, front right, rear left, and rear right pillars.

Industrial Applicability

The loudspeaker according to the present invention is efficient in space since the loudspeaker has high sound quality yet is small in width and thickness. Thus, when mounted in an electronic device such as a thin television, a mobile phone, a PDA, or an automobile, the loudspeaker can facilitate the reduction in width and thickness of the entire device, or can be mounted in a small space, and therefore is useful and has great industrial usefulness.

Reference Signs List

1 television
2 automobile
10 loudspeaker
11 diaphragm
12 edge
13 frame
14 voice coil
15 coupling cone
16 magnet
17 center pole
18 top plate
20 flange
30 diaphragm
31 fitting groove
40 diaphragm
41 reinforcing rib
51 coupling cone
52 reinforcing rib
61 coupling cone
62 twine
63 air hole
70 loudspeaker
71 frame
72 magnet
73 center pole
74 top plate
75 damper
76 damper mounting base
77 reinforcing base
78 roll
79 flat portion
81 damper
82 reinforcing base
83 reinforcing rib
84 coupling cone
85 connecting member
90 loudspeaker
91 frame
92 magnet
93 center pole
94 top plate
95 coupling cone
96 damper attaching base

The invention claimed is:

1. A loudspeaker, elongated as viewed from a direction in which sound waves are emitted therefrom, the loudspeaker comprising:

an elongated flat-plate-shaped diaphragm;

a frame having an opening portion larger than the diaphragm;

an edge placed between an inner periphery of the frame around the opening portion and an outer periphery of the diaphragm and supporting and allowing the diaphragm to easily vibrate in an emission direction of the sound waves emitted from the loudspeaker, the diaphragm being elongated in a direction orthogonal to the emission direction;

a coupling cone extending from a rear surface of the diaphragm, as viewed from the emission direction of the sound waves, and including two elongated portions arranged parallel to a longitudinal direction of the diaphragm, the coupling cone vibrating in conjunction with the diaphragm;

a voice coil wound around at least the two elongated portions of the coupling cone; and a magnetic circuit including:

a center pole located in a center portion of the loudspeaker, as viewed from the emission direction of the sound waves; and top plates and magnets located so as to form magnetic gaps with the center pole, as viewed from the emission direction of the sound waves, wherein the magnetic circuit imparts, to the voice coil, a driving force for generating the sound waves, wherein:

the voice coil is located within the magnetic gaps formed by the top plates, the magnets and the center pole;

a distance between the two elongated portions of the coupling cone is smaller at end positions of the two elongated portions of the coupling cone than at root positions of the two elongated portions of the coupling cone, the end positions being furthest from the rear surface of the diaphragm and the root positions being closest to the rear surface of the diaphragm;

the root positions are inwardly located with respect to an inner periphery of each of the top plates and the magnets; and the end positions are outwardly located with respect to an outer periphery of the center pole.

2. The loudspeaker according to claim 1, wherein the coupling cone has an air-permeable structure.

3. The loudspeaker according to claim 1, wherein a longitudinal length of the coupling cone is 60% or more of a longitudinal length of the diaphragm.

4. The loudspeaker according to claim 3, wherein the root positions of the two elongated portions of the coupling cone are substantially the same as positions of respective nodes of a first resonant mode in a transverse direction of the diaphragm.

5. The loudspeaker according to claim 4, wherein the coupling cone has reinforcing ribs in the two elongated portions, the reinforcing ribs forming projections and depressions parallel to the longitudinal direction of the diaphragm.

6. The loudspeaker according to claim 5, wherein the diaphragm has reinforcing ribs between the two elongated portions of the coupling cone extending from the rear surface of the diaphragm, the reinforcing ribs of the diaphragm forming projections and depressions parallel to the longitudinal direction of the diaphragm.

7. The loudspeaker according to claim 6, wherein the magnetic circuit comprises a plurality of magnetic circuits arranged in the longitudinal direction of the diaphragm, and wherein the loudspeaker further includes a damper located between each adjacent pair of magnetic circuits of the plurality of magnetic circuits, the damper being connected to a part of the end positions of the two elongated portions of the coupling cone and supporting and allowing the coupling cone to easily vibrate in the emission direction of the sound waves.

8. The loudspeaker according to claim 7, wherein the damper has rolls extending parallel to the longitudinal direction of the diaphragm.

9. The loudspeaker according to claim 8, further comprising dampers located on far end sides of the plurality of magnetic circuits arranged at both ends.

10. The loudspeaker according to claim 9, wherein, in the damper, the part connected to the coupling cone is of a truncated pyramidal shape.

11. The loudspeaker according to claim 10, wherein a connecting part between the damper and the coupling cone forms a prismatic structure based on a combination of the damper and the coupling cone.

12. The loudspeaker according to claim 11, wherein, in the coupling cone, a part connected to the damper is integrally molded with part of a reinforcing member to form the prismatic structure when connected.

13. An electronic device comprising a loudspeaker, wherein the loudspeaker is mounted in the electronic device, such that the loudspeaker is elongated as viewed from a direction in which sound waves are emitted therefrom, wherein the loudspeaker comprises:

an elongated flat-plate-shaped diaphragm;

a frame having an opening portion larger than the diaphragm;

an edge placed between an inner periphery of the frame around the opening portion and an outer periphery of the diaphragm and supporting and allowing the diaphragm to easily vibrate in an emission direction of the sound waves emitted from the loudspeaker, the diaphragm being elongated in a direction orthogonal to the emission direction;

a coupling cone extending from a rear surface of the diaphragm, as viewed from the emission direction of the sound waves, and including two elongated portions arranged parallel to a longitudinal direction of the diaphragm, the coupling cone vibrating in conjunction with the diaphragm;

a voice coil wound around at least the two elongated portions of the coupling cone; and a magnetic circuit including:

a center pole located in a center portion of the loudspeaker, as viewed from the emission direction of the sound waves; and top plates and magnets located so as to form magnetic gaps with the center pole, as viewed from the emission direction of the sound waves, wherein the magnetic circuit imparts, to the voice coil, a driving force for generating the sound waves, wherein the voice coil is located within the magnetic gaps formed by the top plates, the magnets and the center pole, wherein a distance between the two elongated portions of the coupling cone is smaller at end positions of the two elongated portions of the coupling cone than at root positions of the two elongated portions of the coupling cone, the end positions being furthest from the rear surface of the diaphragm and the root positions being closest to the rear surface of the diaphragm, wherein the root positions are inwardly located with respect to an inner periphery of each of the top plates and the magnets, and wherein the end positions are outwardly located with respect to an outer periphery of the center pole.

14. The electronic device according to claim 13, wherein the coupling cone has an air-permeable structure.

15. The loudspeaker according to claim 2, wherein a longitudinal length of the coupling cone is 60% or more of a longitudinal length of the diaphragm.

16. The loudspeaker according to claim 15, wherein the root positions of the two elongated portions of the coupling cone are substantially the same as positions of respective nodes of a first resonant mode in a transverse direction of the diaphragm.

17. The loudspeaker according to claim 16, wherein the coupling cone has reinforcing ribs in the two elongated portions, the reinforcing ribs forming projections and depressions parallel to the longitudinal direction of the diaphragm.

18. The loudspeaker according to claim 17, wherein the diaphragm has reinforcing ribs between the two elongated portions of the coupling cone extending from the rear surface of the diaphragm, the reinforcing ribs of the diaphragm forming projections and depressions parallel to the longitudinal direction of the diaphragm.

19. The loudspeaker according to claim 18, wherein wherein the magnetic circuit comprises a plurality of magnetic circuits arranged in the longitudinal direction of the diaphragm, and wherein the loudspeaker further includes a damper located between each adjacent pair of magnetic circuits of the plurality of magnetic circuits, the damper being connected to a part of the end positions of the two elongated portions of the coupling cone and supporting and allowing the coupling cone to easily vibrate in the emission direction of the sound waves.

20. The loudspeaker according to claim 19, wherein the damper has rolls extending parallel to the longitudinal direction of the diaphragm.

* * * * *